US005713792A

United States Patent [19]

Ohzono et al.

[11] Patent Number: 5,713,792

[45] Date of Patent: Feb. 3, 1998

[54] FISHING GAME DEVICE AND A SIMULATED FISHING REEL

[75] Inventors: Yuji Ohzono; Tomohiro Matsunaga; Masaki Matsuno; Futoshi Itoh; Ken Yamanouchi; Hiroyasu Suzuki, all of Tokyo, Japan

[73] Assignee: Sega Enterprises, Ltd., Tokyo, Japan

[21] Appl. No.: 593,092

[22] Filed: Jan. 29, 1996

[30] Foreign Application Priority Data

Jan. 30, 1995 [JP] Japan ..... 7-012407
Jun. 21, 1995 [JP] Japan ..... 7-154386

[51] Int. Cl.[6] ..... A63F 9/22

[52] U.S. Cl. ..... 463/7; 43/4; 242/307; 463/37; 434/247

[58] Field of Search ..... 463/7, 37; 434/247; 482/72; 43/4; 242/307, 257, 264, 288, 390.9, 390.8

[56] References Cited

U.S. PATENT DOCUMENTS 4,637,603 1/1987 Fry et al. .
4,752,878 6/1988 Sigurdsson ..... 364/410
5,334,603 8/1994 Wherlock .

FOREIGN PATENT DOCUMENTS 63-174681 12/1987 Japan .

*Primary Examiner*—Jessica Harrison
*Assistant Examiner*—Michael O'Neill
*Attorney, Agent, or Firm*—Price, Gess & Ubell

[57] ABSTRACT

The present invention relates to a fishing game device. The device comprises line take-up means rotatable forward and reverse; a fishing rod, to a distal end of which is fixed a fishing line fed from the line take-up means; a simulated reel attached to a side opposite to the distal end of the fishing rod and including a handle to be rotated by a player and a brake mechanism for applying a load braking force to the movement of the handle; and control means for controlling a magnitude of the load braking force of the braking mechanism in accordance with the rotational state of the line take-up means.

22 Claims, 16 Drawing Sheets

FISHING GAME DEVICE AND A SIMULATED FISHING REEL

BACKGROUND OF THE INVENTION

1. Field of the Invention

The present invention relates to a fishing game device, and in particular to a fishing game device that can simulate the sensation of fishing while a video recording of real fishing scenes is displayed on a monitor and that thus can easily make a game player feel as though he or she were actually fishing.

2. Related Arts

Various game devices, such as devices for driving games, fight games, and Japanese chess or the game of go, have been widely employed with which a person can engage in many types of leisure activities through simulations that are provided by electronic devices. Various simulation methods have also been proposed for fishing games.

For example, a fishing game device is described in Japanese Unexamined Patent Publication No. Sho 63-174681. The technique disclosed therein is intended to permit a player of the game to feel a drag on a line that is generated by controlling a load that is applied during the swinging of a simulated rod, and a load that is applied when the handle of a reel is rotated.

In actual fishing, a weight is transmitted to a fishing rod from its distal end by the drag provided by a fish, with the fishing rod accordingly being bent.

For fishing, the bending of a fishing rod and the movement at its distal end are, therefore, important to an angler. However, with the fishing game device disclosed in Japanese Unexamined Patent Publication No. Sho 63-174681, the bending of the simulated rod, i.e., the bowing, does not occur, and a player is only aware of a weight that is given to the simulated rod in a vertical direction by a load applied during the swinging of the rod.

When actually fishing, as the handle of a take-up reel is rotated, a load is generated by the resistance provided by a fish. To simulate this, in the above publication it is simply stated that a power generator and a variable load are employed to apply a load when the reel rotating handle is manipulated.

Since a fishing game device is intended to enable a player to enjoy a more realistic fishing experience, and since it is used by many and unspecified persons, it is preferable that such a device have a simple structure and that the device be easy to maintain.

In the fishing game device disclosed in the above publication, the bending of a fishing rod, i.e., the bowing, does not occur, so that it does not always provide a player the sensation of actually fishing.

Another fishing game device is disclosed in U.S. Pat. No. 5,334,027 (issued on Aug. 2, 1994). This device is so designed that a fishing line, which is to be wound around a reel attached to a fishing rod, is directly wound from the distal end of the rod around a take-up reel that is connected to a motor. A tension programmed in advance is reproduced by the motor that is connected to the take-up reel, and is transmitted to the fishing rod and the reel through a single fishing line, so that a player is aware of the tension that is generated.

In this structure, however, a single fishing line that is connected to the reel on the rod is continually moving during the game. Player's hands might be injured by the moving line, and the game is inappropriate for a wide range of game players, among which there may be beginners who are not very familiar with fishing. Further, the reel winding around the single fishing line per se is easily damaged, and when such a device is installed in a game arcade and is used by many players for an extended period of time, it will be broken within only a few days. As a result, the above described game device is not suitable when these things are taken into consideration.

It is therefore one object of the present invention to provide a fishing game device that gives a player a more realistic fishing experience, and that is so structured by taking into consideration its use by many and unspecified persons.

It is another object of the present invention to provide a fishing game device that furnishes a player a more realistic sensation of fishing by employing a main controller, wherein the braking of a take-up reel attached to a fishing rod interlocks with the winding of a fishing line that is fixed to the distal end of the rod.

It is an additional object of the present invention to provide a fishing game device that can reproduce the sensation of a fish biting, hooking, and the fish-on.

It is a further object of the present invention to provide a fishing game device that can reproduce the tension that is applied to a fishing rod so that it is as close as possible to that experienced while actually fishing.

SUMMARY OF THE INVENTION

A fishing game device according to the present invention comprises:

line take-up means rotatable both forward and reverse;

a fishing rod, to a distal end of which is fixed a fishing line led from the line take-up means;

a simulated reel attached to a side opposite to the distal end of the fishing rod, said simulated reel including a handle to be rotated by a player and a brake mechanism for applying a load braking force relative to the movement of the handle; and control means for controlling a magnitude of the load braking force of the braking mechanism in accordance with the rotational state of the line take-up means.

With this arrangement, since the line take-up means is rotatable both forward and backward, drag is applied to the tip of a fishing rod, by rotating the take-up means in the direction in which a fishing line is wound, so that the rod is accordingly bowed. The fishing rod recovers its original shape when the take-up means is rotated in the direction in which the line is fed out. In this manner, a player can watch the bending condition of the fishing rod, and can thus experience the drag of a fish through simulation.

The fishing line fed from the line take-up means is fixed to the tip of the fishing rod. Even when the line is snapped, the line needs only to be fixed and repaired at one point at the distal end of the fishing rod.

Further, the line take-up means has a motor rotating unidirectionally; two clutches, each of which have an input shaft and an output shaft, for being electromagnetically controlled the coupling magnitude of the input shaft and the output shaft; first transmission means for transmitting the rotation of the motor to the two clutches so that the input shafts thereof are rotated in opposite directions; a drum around which the fishing line is taken up; and second transmission means for transmitting the rotation of the output shafts of the two clutches to the drum.

In order to rotate the drum forward or backward in the direction which the fishing line is wound or in the direction which the line is fed out, the line take-up means includes the motor that rotates only unidirectionally, the two clutches, and the first and the second transmission means for transmitting the rotations of them.

When either one of the clutches is coupled, the rotation of the motor that unidirectionally rotates can be changed to provide the forward or the backward rotation of the drum. Since the motor rotates in the only one direction, the load is thus reduced. As a result, there is no time lag from a torque that is caused by the forward and backward rotation of the motor.

In addition, according to the present invention, the fishing game device includes an encoder for outputting an electric signal that corresponds to the rotational amount of the drum. With this encoder, how long or how fast the fishing line is wound in fed out by the line take-up means can be electrically acquired.

As another example, according to the present invention, the simulated reel has a rotary portion coupled with the handle and an encoder for outputting an electric signal which corresponds to the rotational amount of the rotary portion. The braking mechanism has a rotation mechanism portion coupled with the rotary portion and a fixing mechanism portion, and the coupling amount of the rotation mechanism portion and the fixing mechanism portion is electromagnetically controlled.

Since such a simulated reel has the encoder for outputting the electric signal, which corresponds to the rotational amount of the rotary portion connected to the handle, how long or how fast the simulated line is wound in or fed out by a player through the reel can be detected in response to this signal. Therefore, there is no need for the fishing line to actually be wounded on the simulated reel, and the fishing line does not have to be connected directly to the line take-up means. Thus, there is no chance that the fishing line is snapped by the rotation of the reel.

Since the braking mechanism has the rotation mechanism portion coupled with the rotary portion and the fixing mechanism portion and electromagnetically controls their coupling, a load (reaction) that is equivalent to the drag given by a fish can be provided at the reel handle with such simple structure.

Further, a fishing game device according to the present invention comprises:

line take-up means including a line take-up drum winding in and feeding out a fishing line and a hydraulic motor rotatable forward and backward and transmitting a rotational torque to the line take-up drum;

a fishing rod connected at the tip thereof to the fishing line fed from the line take-up drum; and control means for rotating the hydraulic motor forward and backward in accordance with a predetermined simulation program.

A faster and stronger torque change can be reproduced by employing the hydraulic motor. Also, there is less transient change than that of a magnetic particle clutch.

In addition, a fishing game device according to the present invention comprises:

a fishing rod fixed to one end of a fishing line at a tip thereof and susceptible to being vertically moved by a player and to being bent;

line take-up means, connected to another end of the fishing line, for winding in and feeding out the fishing line;

a simulated reel, attached to a side opposite to the tip of the fishing rod, having a handle rotated by a player and a braking mechanism for providing a braking force to resist the rotation of the handle; and control means for controlling a braking force magnitude of the braking mechanism in accordance with a tension magnitude which is given to the fishing line by the line take-up means.

The tension magnitude given to the fishing line is determined by the speed of the simulated reel rotation. The tension magnitude given to the fishing line is determined in accordance with the degree to which the fishing rod is bent. The degree to which the fishing rod is bent is determined by an angle of the rod and the amount of the line that is wound in by the line take-up means.

DETAILED DESCRIPTION OF THE PREFERRED EMBODIMENTS

Figure 1:
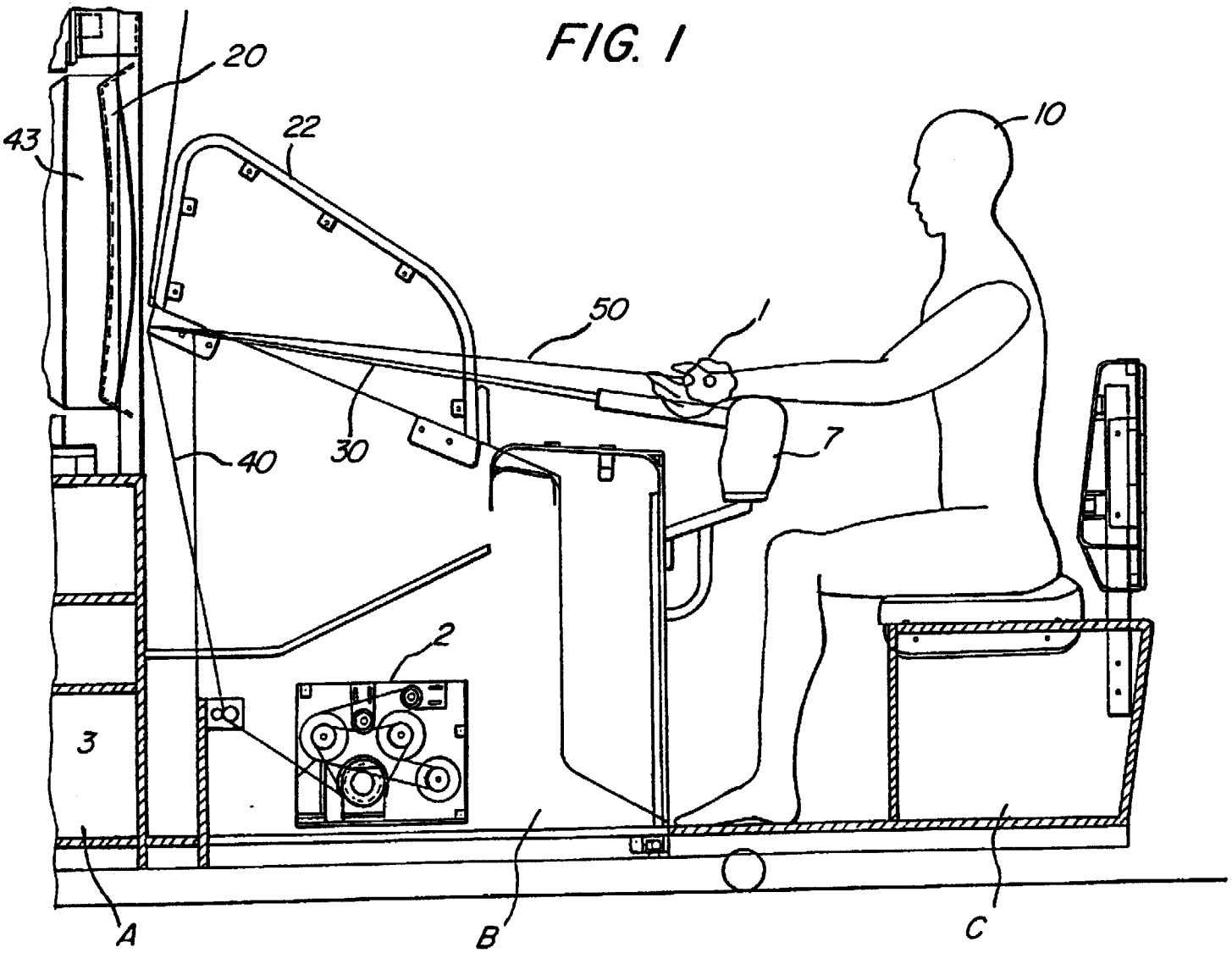
FIG. 1 is a side view of a fishing game device according to one embodiment of the present invention.

The preferred embodiments of the present invention will now be described while referring to the accompanying drawings. The same reference numbers and symbols are used to denote corresponding or identical components in the drawings.

[Fishing simulation device and a simulated reel]

FIG. 1 is a side view illustrating the entire fishing game device according to the present invention, with a partial cross section for easy understanding.

Figure 2A:
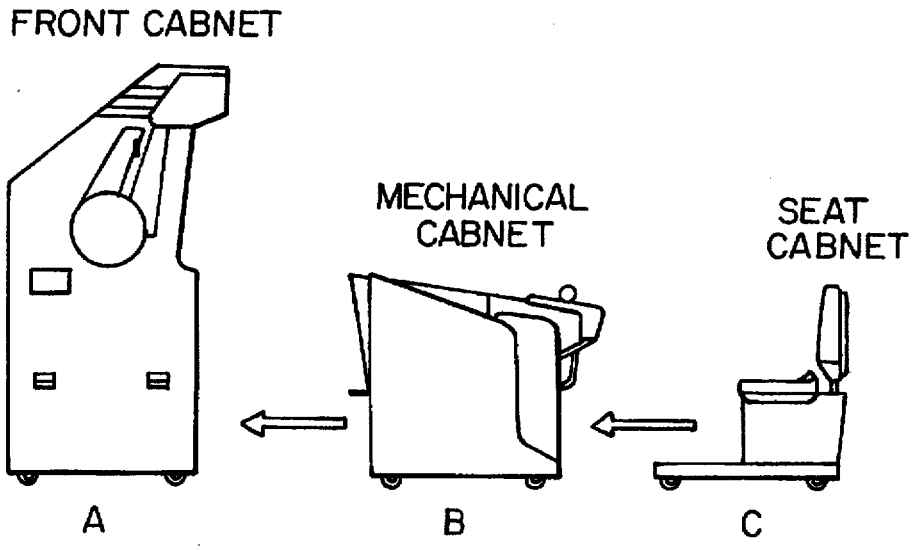
FIGS. 2A and 2B are diagrams for explaining the structure of a cabinet assembly for the device according to the embodiment of the present invention.

The device according to one embodiment of the present invention is a style that is installed in a game center or arcade, etc. As is shown in FIG. 2A explaining the arrangement of a cabinet assembly in the device, a cabinet assembly consists of a front cabinet A, a mechanical cabinet B and a seat cabinet C.

Figure 2B:
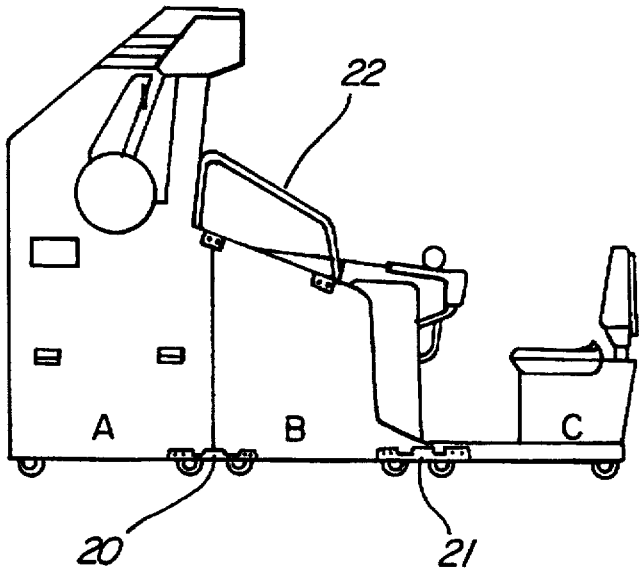

As is shown in FIG. 2B, these cabinets are integrally connected at their lower portions by joint brackets 20 and 21. Reference number 22 in FIG. 2B denotes a side protector.

Referring back to FIG. 1, the front cabinet A contains a main board 3 that serves as a primary portion for a control board, which controls a fishing game as a whole and which will be described later. Further, a monitor 43 is also provided which displays either a video recording of actual fishing scenes or the existing situation of the game as the game progresses. A front face 20 of the monitor 43 is a CRT surface when the monitor 43 is a CRT, or a screen on which a video image is projected when the monitor 43 is a projection monitor.

A player 10 is seated in the seat cabinet C and faces the mechanical cabinet B in which the mechanic portion the fishing game device of the present invention is contained, and thus a game is begun. A fishing rod 30 in the mechanical cabinet B is tapered toward its tip, as is an ordinary fishing rod. A simulated reel is so attached to the fishing rod 30 that it is positioned near a hand of the player 10.

The simulated reel 1 is so structured that it characterizes the fishing game device of the present invention, which will be described later. To explain briefly, the simulated reel 1 includes an encoder for detecting its rotation and a clutch that provides a braking function for controlling the rotation. One end of a simulated fishing line 40 is fixed to the tip of the fishing rod 30. The other end of the fishing line 40 is led to a line take-up device 2 that has a structure characterized by the present invention, which will be described in detail later. An extra portion of the line 40 is wound around the drum of the line take-up device 2.

A dummy line 50 is made of the same material as the fishing line 40 and is fastened securely extending from the distal end of the fishing rod 30 to the simulated reel 1. Therefore, it seems to the player 10 that the dummy line 50 is fed from the simulated reel 1, passes through the tip of the fishing rod 30, and is connected to the line take-up device 2.

Actually, however, since the dummy line 50 that extends from the distal end of the fishing rod 30 to the simulated reel 1 is secured at both ends, it is not affected by the dragging force exerted by the line take-up device 2 or by the rotation of the simulated reel 1. Thus the line will not be broken or snapped by the movement of the take-up device 2 and the simulated reel 1, and the player 10 will not be injured by the fishing line 50 that is fed from the simulated reel 1. Therefore, in the present invention, the player 10 can more realistically experience the sensation of actually fishing, while at the same time, there is a reduced probability that the game will be interrupted due to a line break or snap.

In FIG. 1, the distal end of the fishing rod 30 can be raised by the manipulation of the player 10 to adjust for a fish bite, for setting a hooking, etc. The vertical movement of the fishing rod 30 is detected by an angle detector (not shown) that is provided at a portion 7 at the butt of the fishing rod 30.

Figure 3:
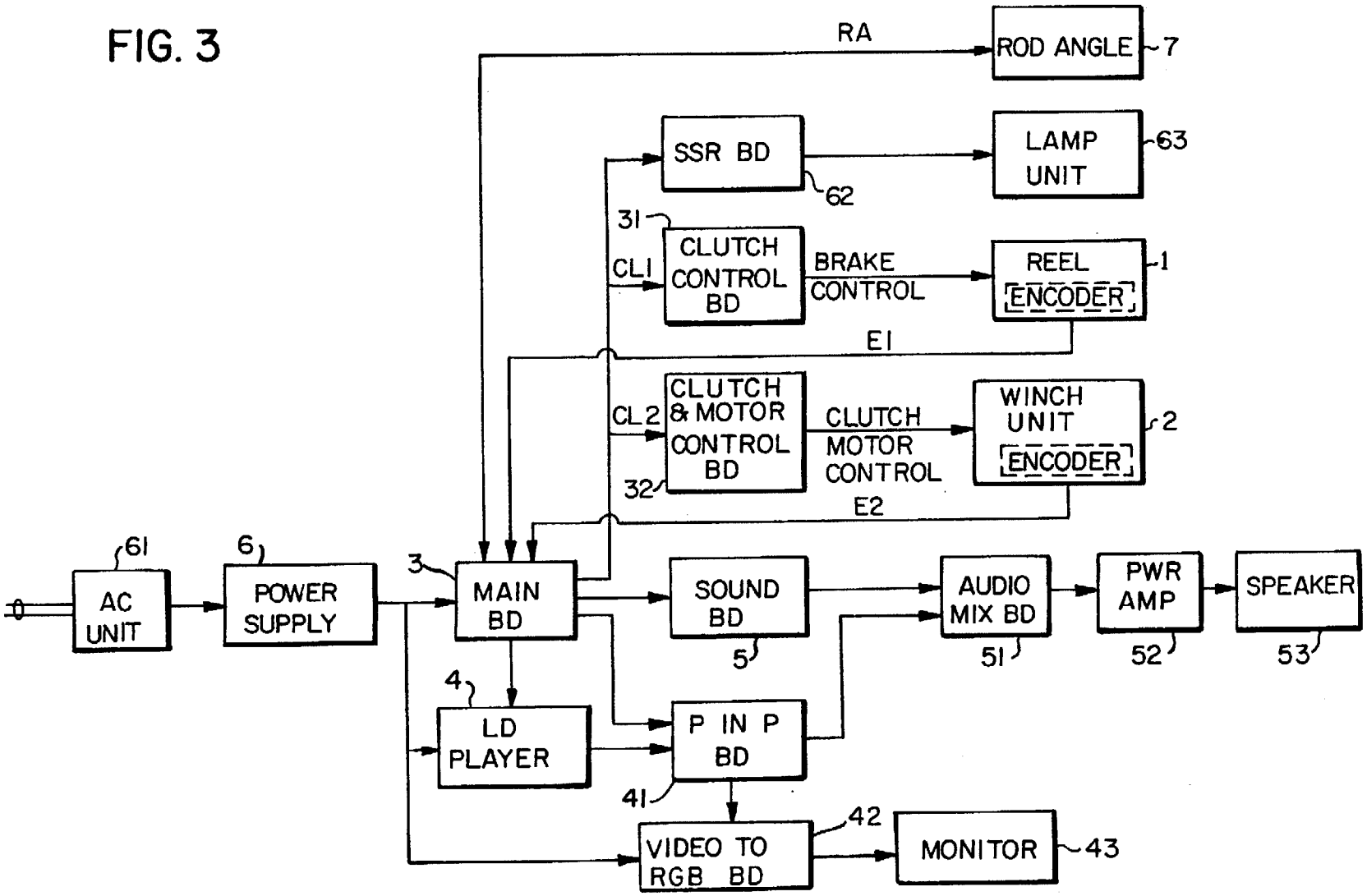
FIG. 3 is a block diagram illustrating the control system for the device according to the present invention.

FIG. 3 is a block diagram illustrating the control system for the device according to the embodiment of the present invention. An AC current supplied from an alternating current power supply unit 61 is converted into a direct current by a voltage supply circuit 6, and a required direct current voltage is supplied for each section.

Internally, the main board 3 includes a CPU that controls the individual sections of the control system. The operations of the individual sections will now be described while referring to the other detailed diagrams as needed.

Braking control for the simulated reel 1 is performed through a clutch control board 31 in response to commands from the main board 3. Further, an electric signal E1 that corresponds to the amount of the rotation of the handle of the simulated reel 1 is output from an encoder to the main board 3.

Figure 4:
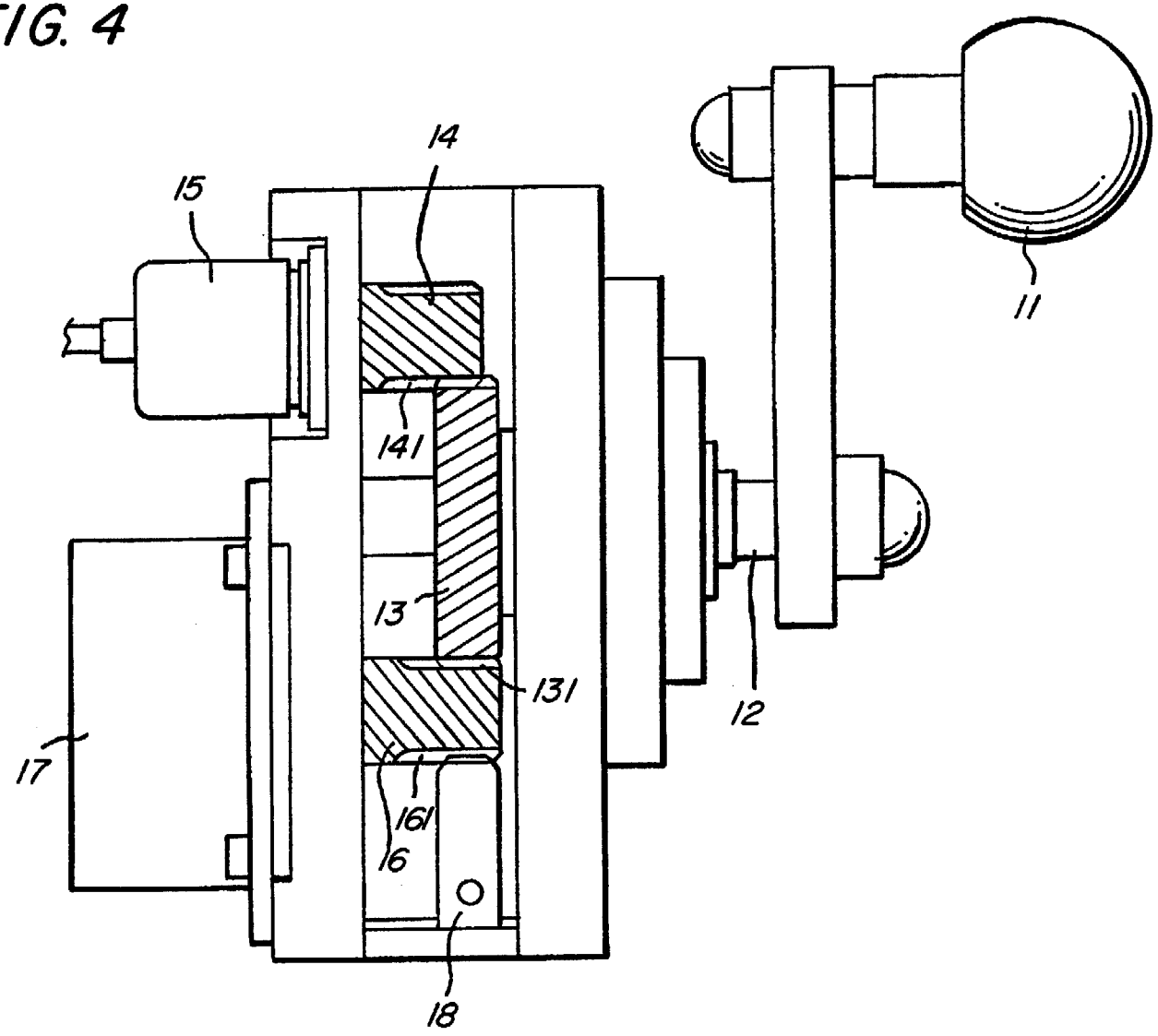
FIG. 4 is a diagram showing one embodiment of a simulated reel.

An example of the simulated reel 1 that is the feature of the present invention is shown in FIG. 4. A handle 11 is rotated by the player 10 in the same manner as he would wind in or feed out the fishing line 40 in accordance with the drag that seems to be generated by an actual fish.

A rotary shaft 12 is connected to the handle 11. A gear 13, with teeth 131, is fitted around the rotary shaft. Gears 14 and 16 have teeth 141 and 161, respectively.

The shaft of the gear 14 is coupled with an encoder 15. The rotation of the handle 11 is transmitted to the encoder 15 through the gears 13 and 14. An electric signal that corresponds to the rotation of the handle 11 is output from the encoder 15 to the main board 3, as is shown in FIG. 3.

The gear 13 of the simulated reel 1 is further coupled with the gear 16 that has the teeth 161. The shaft of the gear 16 is coupled with a braking mechanism 17, which is a magnetic particle clutch.

To explain briefly, included in the braking mechanism 17 is a rotary shaft that is coupled with the shaft of the gear 16 and a fixing portion. Magnetic particles are interposed between these rotary shafts and the fixing portion. The rotary shaft is more securely coupled with the fixing portion by concentrating the magnetic particles through electrical excitation.

The magnitude of the coupling of the rotary shaft with the fixing portion is proportional to the level of an excitation current. When the strength of the coupling of the rotary shaft with the fixing portion is increased, a load is applied through the gears 16 and 13 with respect to the rotation of the handle 11.

The output of the encoder 15 and the control of the excitation current for the braking mechanism 17 will be explained later in association with an example where the fishing game device of the present invention is actually used.

In FIG. 4, one end of a leaf spring 18 is fixed and the other end engages the teeth 161 of the gear 16. In accordance with the rotation of the gear 16, the distal end of the leaf spring 18 is vibrated to produce a latching sound that is the same as that provided by an actual reel.

Referring back to FIG. 1, the line take-up device 2 is so designed that it transmits the rotation of the motor through the clutch to the line take-up drum, as will be explained in detail later.

The engagement and the disengagement of the clutch is controlled by the main board 3 through a clutch/motor control board 32. Further, the line take-up device 2 has an encoder for outputting an electric signal E2 that corresponds to the rotational distance of the line take-up drum. The signal E2 is input to the main board 3.

The control based on the encoder output and the engagement and disengagement of the clutch will also be explained in detail later in association with the example where the fishing game device of the present invention is used.

There is one more operation that is controlled by the player 10, vertical movement of the fishing rod 30. As is shown in FIG. 3, the angle of the vertical displacement of the fishing rod 30 is detected by the angle detector 7, and a signal RA indicating the movement is supplied to the main board 3.

[Line take-up device]

Figure 5:
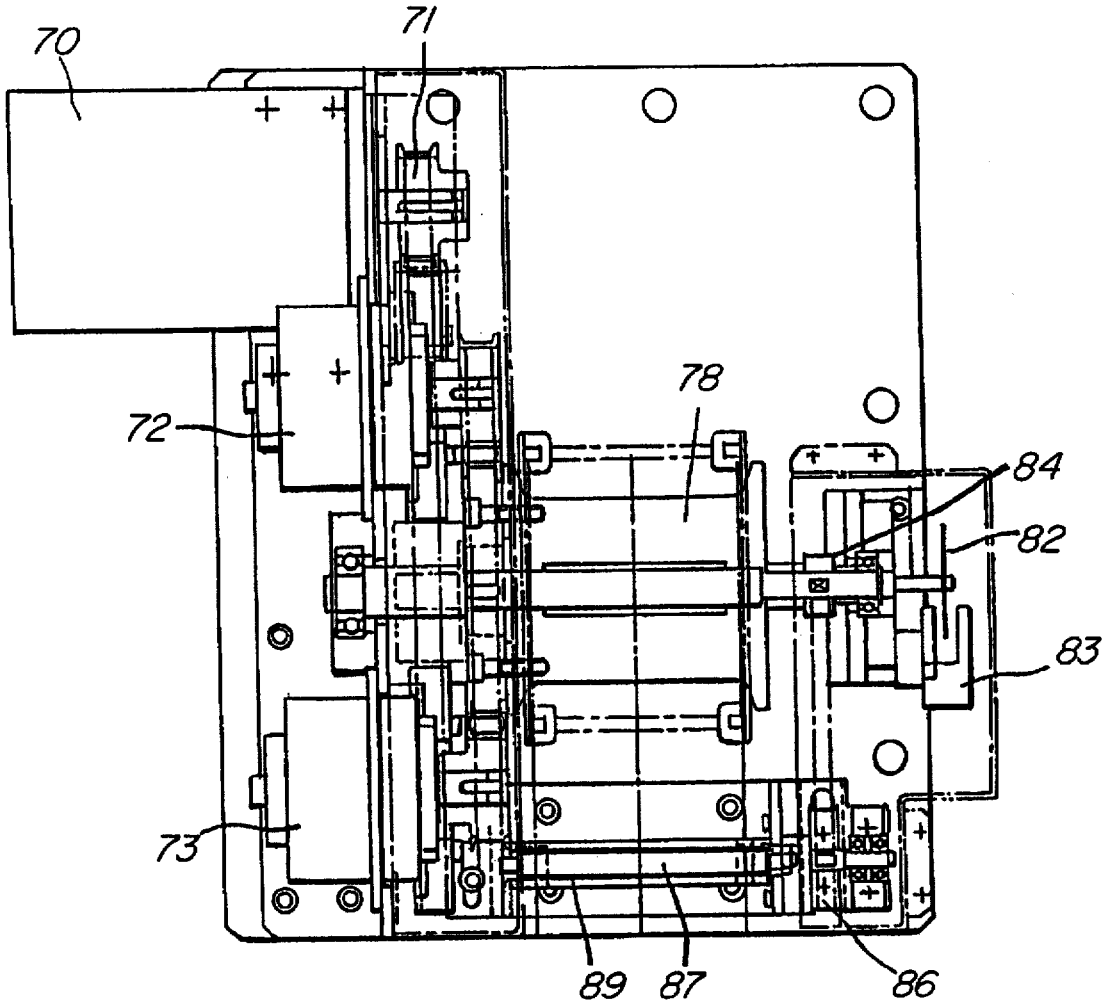
FIG. 5 is a partially exploded top view of a fishing line take-up device.
Figure 6:
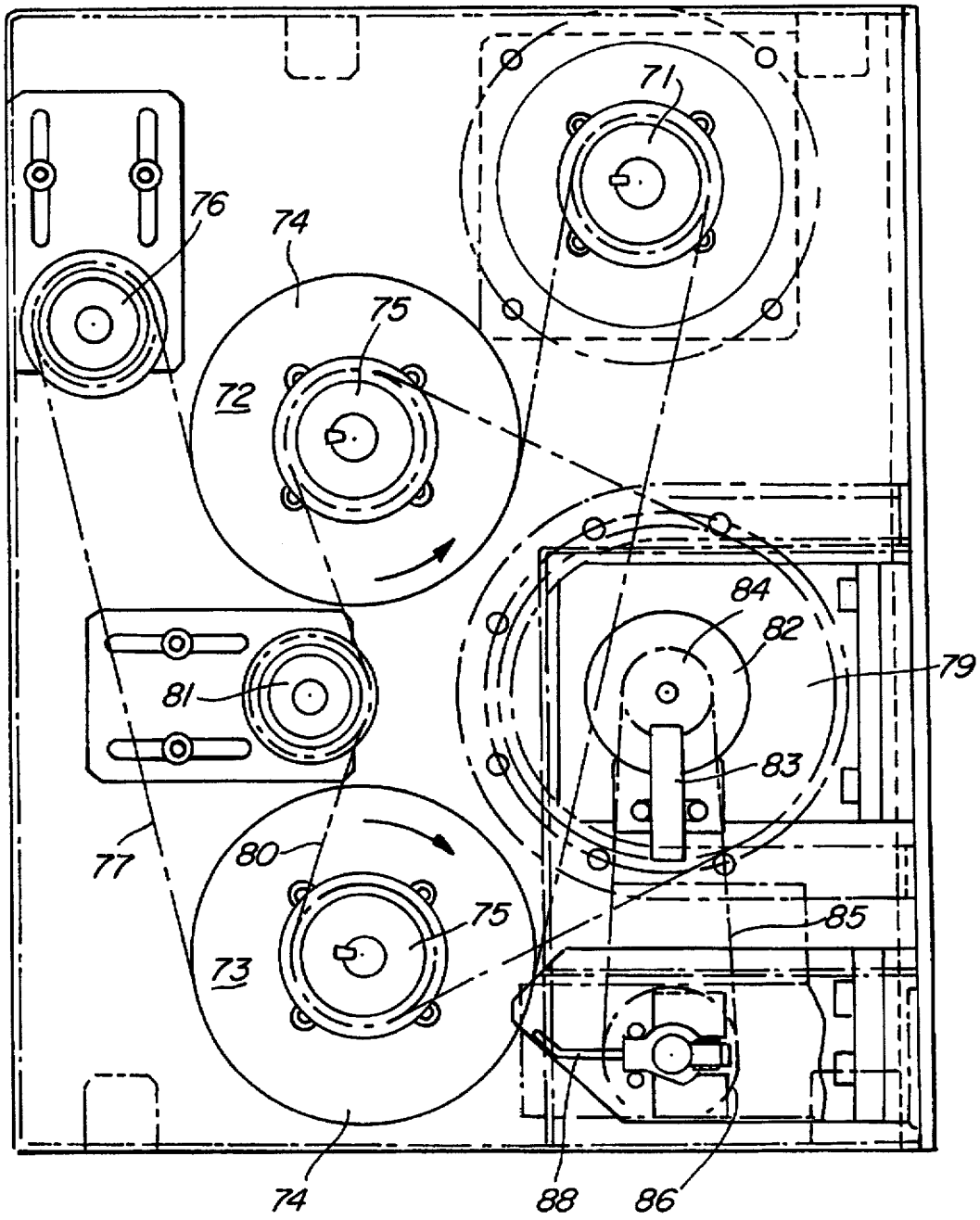
FIG. 6 is a partially exploded side view of the device in FIG. 5 when viewed from the right.

FIG. 5 is a partially exploded top view of the line take-up device 2 and FIG. 6 is a partially exploded side view as viewed from the right side in FIG. 5. The left side in FIG.

6 corresponds to the upper side of the line take-up device 2. The detailed structure will be explained while referring to FIGS. 5 and 6.

A timing pulley 71 is attached to a drive motor 70. Like magnetic particle clutches 72 and 73, which are sold by Ogura Clutch Co., Ltd. each have an input shaft and an output shaft. Magnetic particles are interposed between the input shaft and the output shaft.

The input shaft is coupled with the output shaft by concentrating the magnetic particles electromagnetically, i.e., through excitation from the exterior, and the rotation of the input shaft is transmitted to the output shaft. An excitation current for the magnetic particles is controlled to adjust the coupling strength of the input shaft with the output shaft.

Timing pulleys 74 and 75 are fitted around the input shaft and the output shaft respectively. A pulley idler 76 is provided whose installation position can be adjusted. A timing belt 77 is stretched around the timing pulley 71, the timing pulley 74 of the magnetic particle clutch 72, the pulley idler 76, and the timing pulley 74 of the magnetic particle clutch 73, as is shown in FIG. 6.

Therefore, the timing pulleys 74 around the input shafts of the magnetic particle clutches 72 and 73 are rotated in opposite directions. A timing pulley 79 is fitted around the shaft of a line take-up drum 78.

A timing belt 80 is stretched around the timing pulley 79 and the timing pulleys 75 that are fitted around the output shafts of the respective magnetic particle clutches 72 and 73, as is shown in FIG. 6. The tension force exerted by the timing belt 80 is adjusted by changing the installation position of a pulley idler 81.

An encoder is attached to an extended portion of the shaft of the line take-up drum 78. The encoder includes a slit disk 82, which has slits around its circumference, and a sensor 83, which is a photocoupler that sandwiches the slit disk 82 from both sides.

As the line take-up drum 78 rotates, light that passes through the slits of the slit disk 82 is detected and converted into an electric signal, which is thereafter output. This output is sent to the main board 3, as is shown in FIG. 3, which has been described above.

A timing pulley 84 is located between the encoder and the line take-up drum 78. The rotation of the timing pulley 84, i.e., the rotation of the line take-up drum 78, is transmitted to a timing pulley 86 of a line guide portion by a timing belt 85.

The line guide portion moves the fishing line 40 to the right and to the left along the axial direction in synchronization with the rotation of the line take-up drum 78, so that the fishing line 40 is uniformly wound around the line take-up drum 78.

The line guide portion has a traverse cam 87, which is the primary portion, and a line guide 88. The rotation of the timing pulley 86 is transmitted to the traverse cam 87. The traverse cam 87, therefore, is rotated synchronously with the rotation of the line take-up drum 78. Reference number 89 denotes a protection cylinder for the traverse cam 87.

Figure 7:
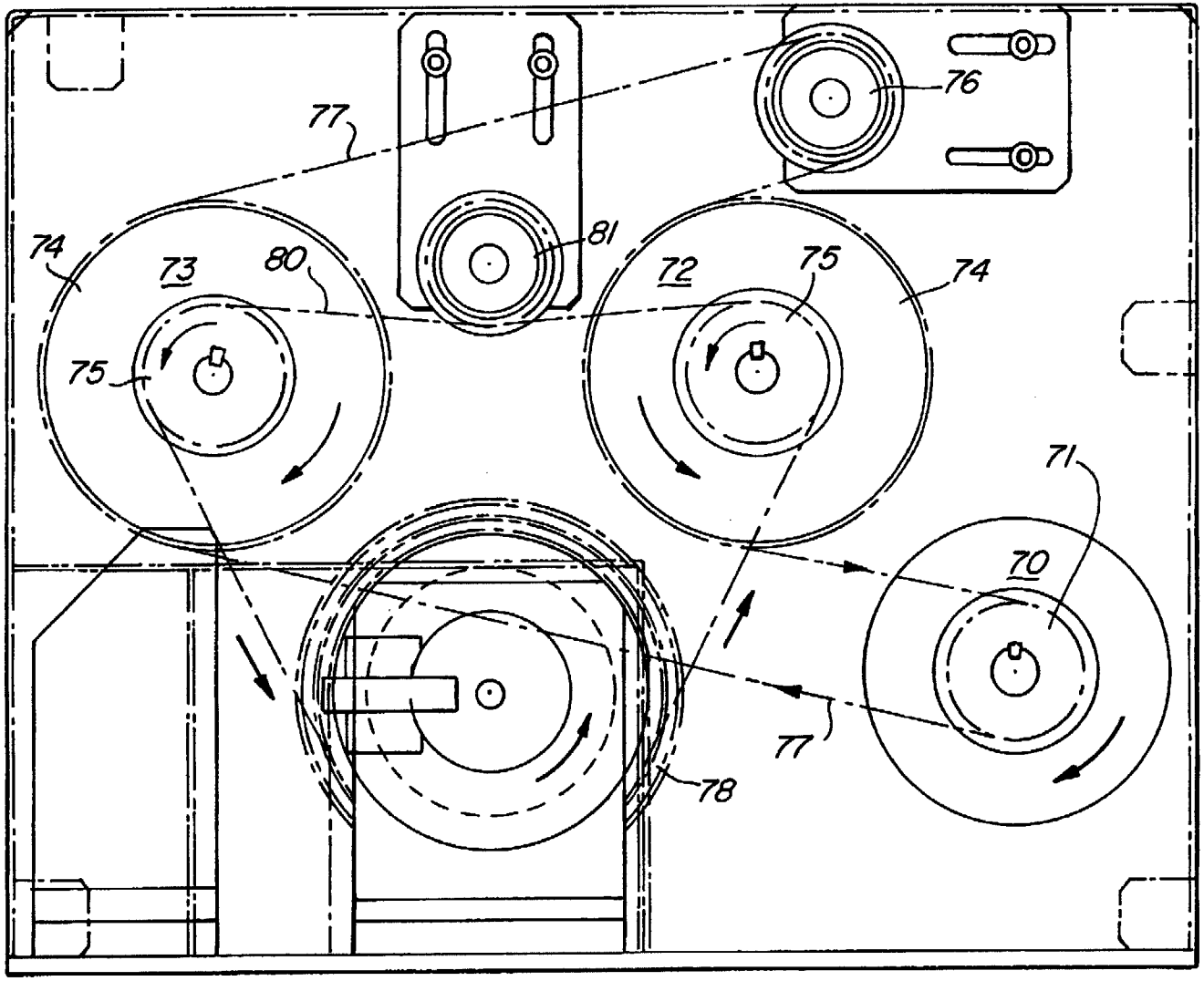
FIG. 7 is a diagram (No. 1) for explaining the relationship between the control of a magnetic particle clutch and the direction in which a take-up drum rotates.
Figure 8:
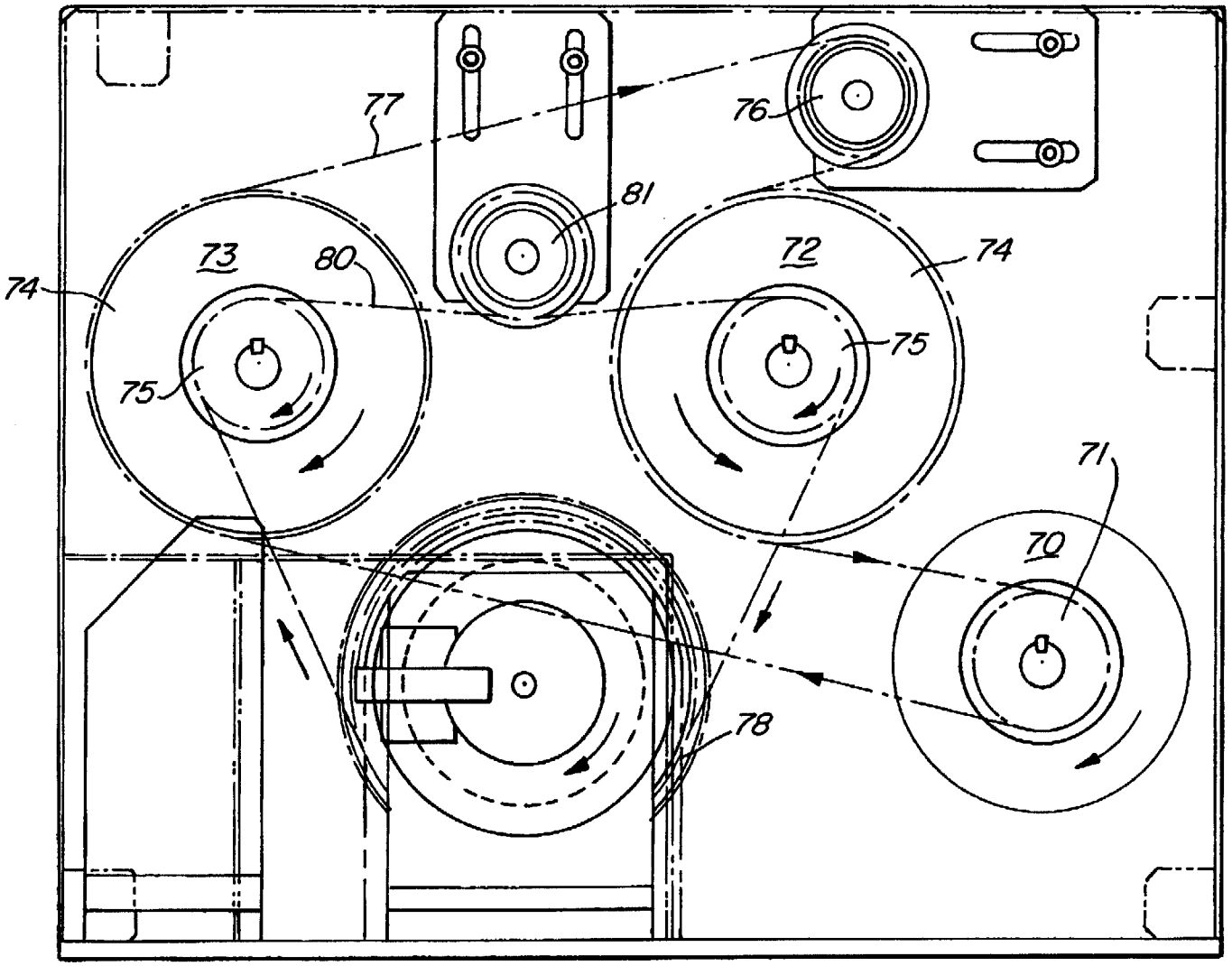
FIG. 8 is a diagram (No. 2) for explaining the relationship between the control of the magnetic particle clutch and the direction in which the take-up drum rotates.

FIGS. 7 and 8 are diagrams, based on FIG. 6, for explaining the relationship between the control of the magnetic particle clutches 72 and 73 and the rotation direction of the take-up drum 78. When the motor 70 is rotated clockwise, its rotation is so transmitted by a timing belt 77 that the timing pulleys around the input shafts of the magnetic particle clutches 72 and 73 are rotated in the directions indicated by arrows in FIGS. 7 and 8. That is, the input shaft of the magnetic particle clutch 72 is rotated counterclockwise and the input shaft of the magnetic particle clutch 73 is rotated clockwise.

Let us suppose that an excitation current is supplied to the first magnetic particle clutch 72 to couple its input shaft with its output shaft. See FIG. 7. In this case, the rotation of the input shaft of the magnetic particle clutch 72 is transmitted to the output shaft. Thus, as is shown in FIG. 7, the timing pulley 75 that is fitted around the output shaft of the magnetic particle clutch 72 is rotated counterclockwise.

The timing pulley 75, of the magnetic particle clutch 73, that is connected to the timing pulley 75 of the magnetic particle clutch 73 by the timing belt 80, and the take-up drum 78 are also rotated counterclockwise.

On the contrary, suppose that an excitation current is supplied to the second magnetic particle clutch 73 to couple its input shaft with its output shaft. In this case, the rotation of the input shaft of the magnetic particle clutch 73 is transmitted to the output shaft.

The input shaft of the magnetic particle clutch 73 rotates clockwise, as is shown in FIG. 8, and accordingly, the timing pulley 75 that is fitted around the output shaft of the magnetic particle clutch 73 is rotated clockwise.

The timing pulley 75, of the magnetic particle clutch 72, that is connected to the timing pulley 75 of the magnetic particle clutch 73 by the timing belt 80, and the take-up drum 78 are also rotated clockwise.

As is previously described, the degree to which the input shaft is coupled with the output shaft of the clutch can be changed by controlling the excitation current that is supplied to the magnetic particle clutches 72 and 73. Therefore, in accordance with the degree of coupling, a variable load is applied to the fishing line 40 that is fed from the take-up drum.

[Control of a fishing game]

The description of operation of the fishing game device of the present invention will now be given by explaining an example use of the device while referring to FIGS. 9 through 12. FIGS. 1 through 8 will be also be referred to when necessary.

Figure 9:
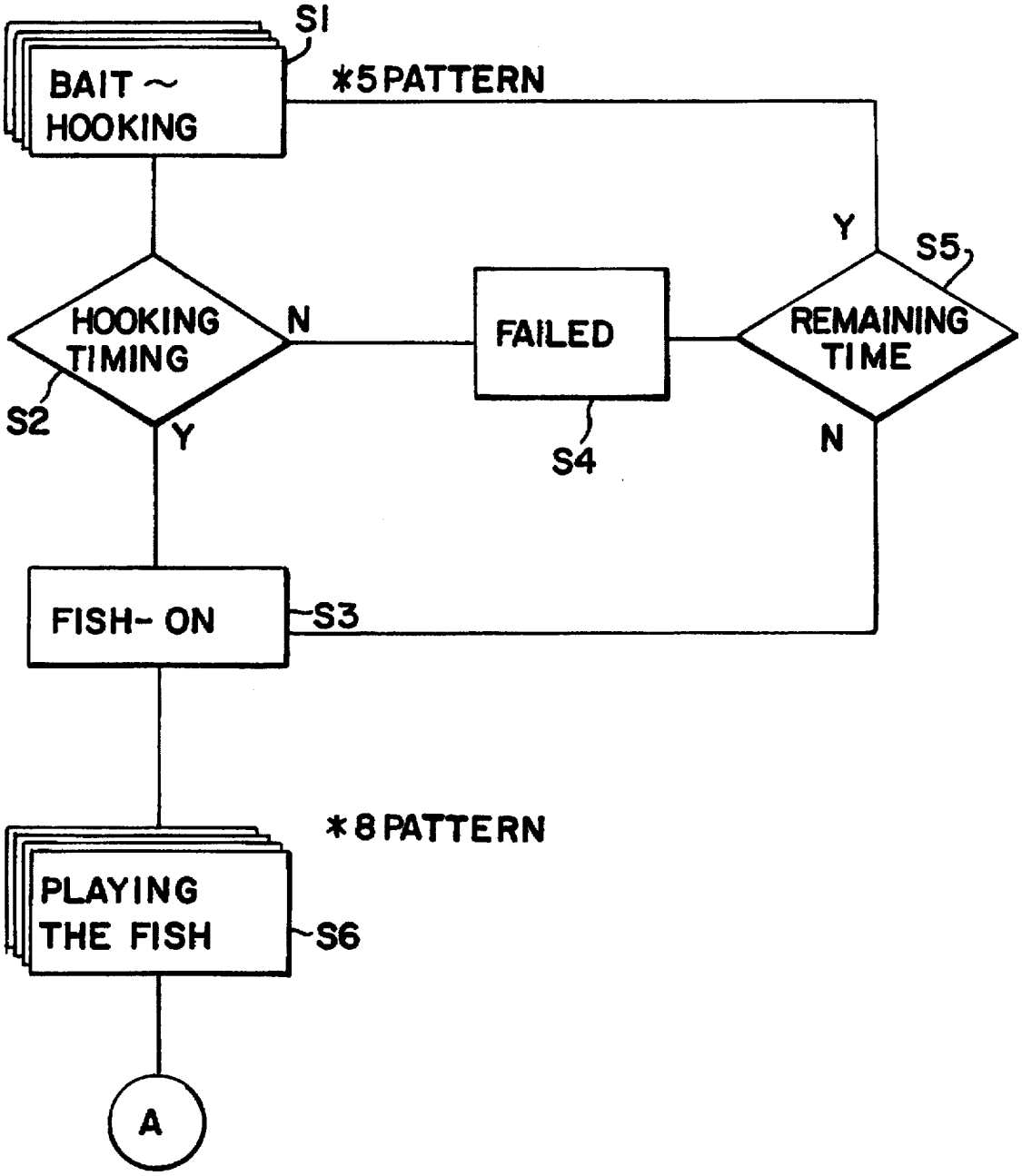
FIG. 9 is a flowchart (No. 1) showing the operation of the fishing game device of the present invention.

FIG. 9 is a flowchart (No. 1) showing the operation of the example device of the present invention that is employed. Before a fishing game is begun, first, a player inserts a coin into a slot (not shown) of the device, and selects the level of play for the game, i.e., beginner, intermediate, or advanced.

In accordance with the selected play level, the main board 3 (see FIG. 3) drives a sound board 5 and a laser disk player 4 in accordance with an internally stored fishing game program. A sound signal that accompanies a predetermined game is output from the sound board 5 through an audio mixer board 51 and a sound amplifier 52, and a corresponding sound is released from a loudspeaker 53.

Figure 16:
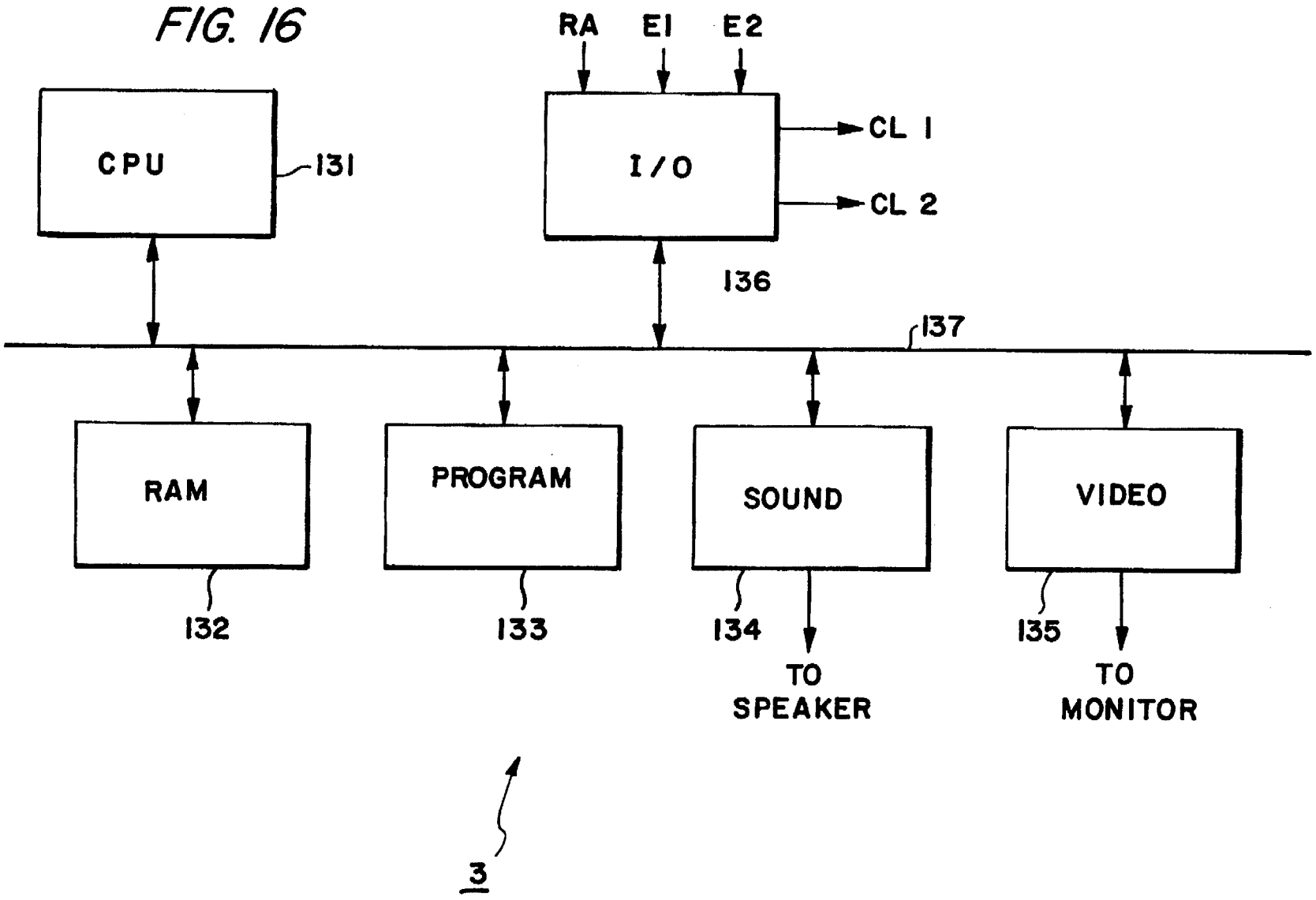
FIG. 16 is a schematic block diagram showing a main board.

According to some alternative structures, the main board 3 can function as the sound board 5, the audio mixer board 51, and the sound amplifier 52, which are enclosed by the dotted line in FIG. 3. In this case, a sound signal is directly transmitted from the main board 3 to the loudspeaker 53. Further, the laser disk player 4 may be replaced with a CD player. In this case, a compressed image signal is decompressed by the main board 3, and the resultant image signal is then supplied directly to the monitor 43. The schematic block diagram of such a main board 3 is shown in FIG. 16. A CPU 131; a RAM 132, which is used for computation; a program memory 133, in which a computer program for a fishing game is stored; a sound processor 134, for performing sound processing; an image processor 135, for decompressing an image signal and for generating an analog signal for the monitor; and an input/output section 136, for receiving signals E1 and E2 from encoders and an angle detection signal RA and for outputting a clutch control signal, are connected by a bus 137.

Image signals for a predetermined number of frames are transmitted from the laser disk player 4 to a picture-in-picture board 41. The picture-in-picture board 41 is a circuit that corresponds to the audio mixer board 51 for sounds and that synthesizes image signals. The picture-in-picture board 41 mixes an image signal, from the laser disk player 4, with a display image signal, from the main board 3, that corresponds to the progression of the game, and transmits a resultant image signal by a single frame to an RGB board 42.

The RGB board 42 converts the image signal that is received from the picture-in-picture board 41 into a video signal, which is thereafter displayed on the monitor 43. More specifically, as is shown in FIG. 9, at the start of the game, a predetermined initial scene is displayed. In this embodiment, there are five video image patterns that can be employed as the predetermined initial scene, and a scene showing a fishing line being casted into the sea, for example, is displayed (step S1).

The five set of video image patterns are stored on a disk in the laser disk player 4, and one set of them is output at random under the control of the main board 3.

[Control for a bite, hooking, and a fish-on condition]

Actual fishing begins with a fish taking a bait while a fishing line is dropping. The taking of the bait by a fish is called a bite. When an angler has a bite, the tip of a fishing rod moves up and down slightly. The speed and strength of the vertical movement varies depending on the type of fish. When an angler feels a bite, he sets the hooking, which is performed by raising the fishing line or the rod at a predetermined timing. When the angler has performed the hooking at an appropriate time, a fish takes the bait and is caught on a fishing hook. In other words, a fish-on condition exists. This timing also varies depending on the type of fish.

In the game device in this embodiment, the timing at which the player 10 has performed the hooking is examined (step S2). When the timing for the player's performance of the hooking matches a predetermined time, it is determined that a fish-on condition exists (step S3).

Figure 10:
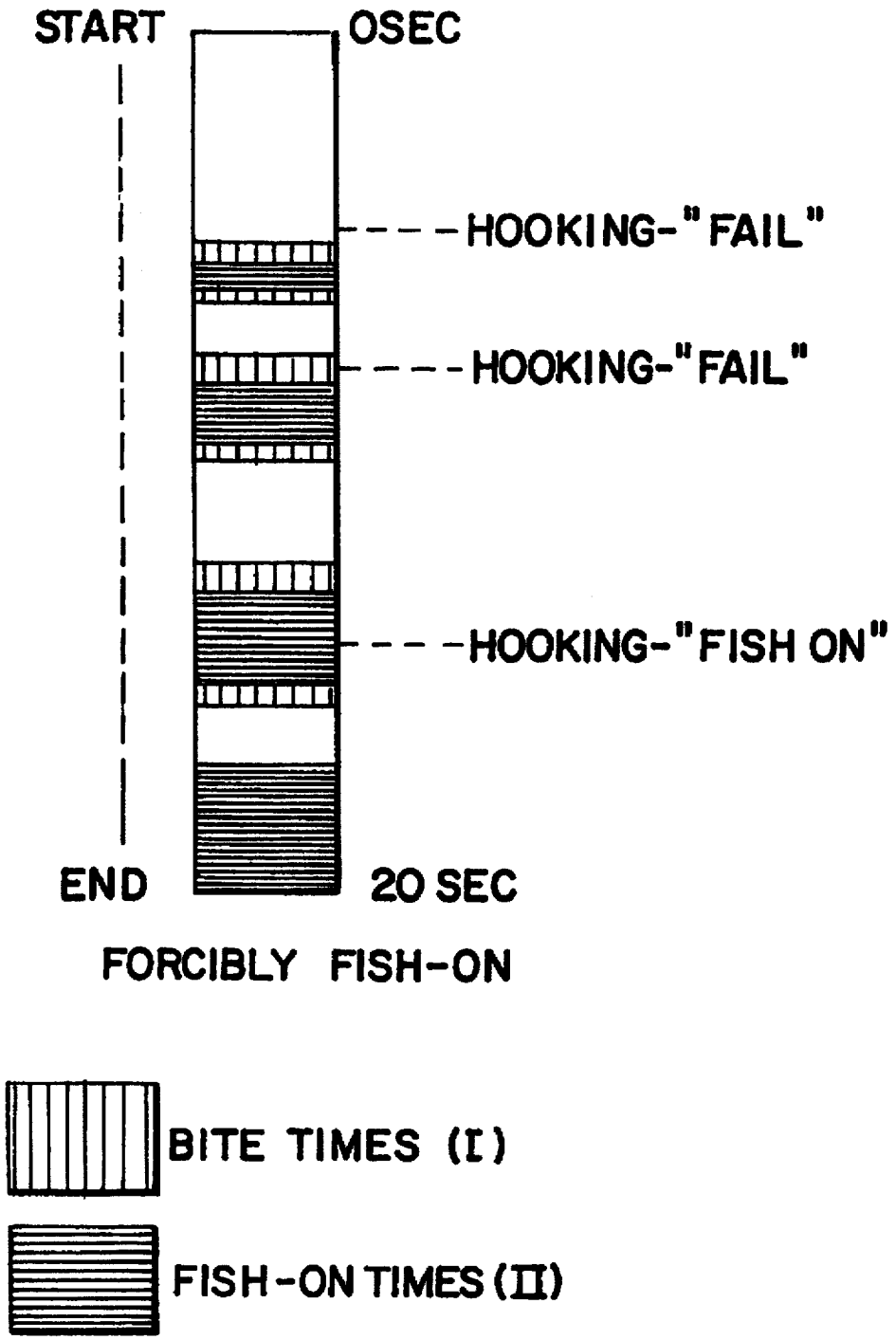
FIG. 10 is a time chart for the operation in FIG. 9.

The determination process for the hooking timing will be explained while referring to FIG. 10. A plurality of hooking times (I) are provided within a predetermined time period 0 through 20 seconds. During the hooking times, the take-up drum 78 of the line take-up device 2 is rotated forward and backward.

When the take-up drum 78 is rotated forward or backward, the tip of the fishing rod 30, to which is fixed the fishing line 40 that is wound around and fed from the take-up drum 78, is moved vertically. The vertical movement of the tip of the fishing rod 30 alerts the player 10 to the fact that a state exists in which a fish has taken the bait, i.e., he has a bite.

When actually fishing, an angler performs hooking, wherein the angler moves the fishing rod up and down so as to hook a fish after it has taken the bait. In the fishing game device of the present invention, a check is performed to determine whether or not the timing for the hooking matches any of the fish-on times (II), which are provided in the bite time periods (I). The main board 3 compares the fish-on times (II) in the plurality of bite time periods (I) with the timing when the player 10 raised the fishing rod 30, i.e., the timing for the hooking.

The timing at which the fishing rod 30 is pulled up by the player 10 can be determined as follows. The fishing line fed from the take-up drum 78 of the line take-up device 2 is fixed to the tip of the fishing rod 30. When the fishing rod 30 is pulled up by the player 10, the tip of the fishing rod 30 is raised, and the take-up drum 78 is rotated to feed the fishing line 40 by a distance which corresponds to the distance that the tip is raised.

Since a pulse signal that corresponds to the amount of rotation of the take-up drum 78 is output by a sensor 83, when the output of the sensor 83 exceeds a predetermined amount of rotation at the fish-on timing (II) during the determination period for the bite timing (I), the main board 3 determines that the fish-on is obtained.

Another method by which the timing for pulling up the fishing rod is determined involves the employment of an angle detection signal RA from the angler detector 7, which is provided near the butt of the fishing rod 30. When the fishing rod 30 is too flexible, the vertical movement of the fishing rod 30 might not be accurately transmitted to the fishing line 40. In such a case, a method by which the angle detector 7 is employed to directly detect the vertical movement of the fishing rod 30 is effective. When, upon the receipt of the angle detection signal RA from the angle detector 7, the main board 3 recognizes that the vertical movement has a velocity that is greater than an angular velocity in a predetermined direction, the main board 3 determines that a valid hooking operation has been performed.

The bite of a fish can be realized by the take-up control of the line take-up device 2, as is described above. In FIG. 10, a plurality of periods for bite are provided. Different take-up operations are performed in accordance with fish types in the individual bite periods, so that the sensation of bite for various types of fish can be provided for the player 10. The player 10 can therefore perform the hooking of a target fish in accordance with the sensation. In this manner, the player 10 can be provided a more realistic fishing experience.

When it is determined that a fish-on condition exists (step S2:Y), a display signal for that effect is transmitted from the main bard 3 through the picture-in-picture board 41 and the RGB board 42 to the monitor 43 for its display (step S3).

At the hooking timing determination (step S2), when the condition is not determined to constitute a fish-on (step S2:N), it means that the hooking attempt has failed (step S4). When the hooking attempt has failed (step S4), nothing is displayed in the monitor 43, and the main board 3 examines a timer to determine whether it has counted up to a predetermined value (e.g., 20 seconds) (step S5).

When there is time remaining before a predetermined value (e.g., 20 seconds) is attained, program control returns to step S1 and the above process is repeated (step S5:Y). When there is no time left (step S5:N), program control forcibly moves to a fish-on process (step S3) (see FIG. 10).

In the fish-on process, the main board 3 supplies clutch control signals CL1 and CL2 to the clutch control boards 31 and 32, respectively, in order to reproduce the movement of the fishing rod 30 and the simulated reel 1 in accordance with the type of a fish that is hooked. The player 10 can therefore experience the fish-on condition that is provided by his or her own manipulation of the hook. The clutch control signals CL1 and CL2 are patterns that correspond to fish types that are programmed in advance, and are read and supplied from the program memory 133 of the main board 3.

[Playing-the-fish control]

When the fish-on process has been completed (step S3), the main board 3 reads, from the laser disk player 4, an image that shows a struggle with (the playing of) a fish and displays that image on the monitor 43, and also releases associated sounds through the loudspeaker 53 (step S6). In this embodiment, eight set of patterns are prepared as images for the playing of a fish. At the same time as the image is displayed, in response to the clutch control signals CL1 and CL2 that correspond to the program on the main board 3, the tension that corresponds to the fish type that is hooked is reproduced and applied to the fishing line 40 and the simulated reel 1. More specifically, a torque is given in a direction in which the fishing line 40 is wound around take-up drum 78 of the take-up device 2, so that greater tension is applied to the fishing line 40 when the drag produced by a fish occurs. Further, an excitation current is supplied to the magnetic particle clutches so that the player 10 is afforded the sensation of a weight being applied to counter the rotation of the simulated reel 1.

During the display of the image for the playing of the fish, the player 10 pulls up the fishing rod 30, or concurrently rotates the handle 11 of the simulated reel 1, so as to simulate the gradual winding of the fishing line gradually.

In actual fishing, if a fishing rod is quickly moved up or if the speed at which a reel is rotated to wind in a fishing line is greater than a predetermined value, a tension greater than a permitted tension is applied to the fishing line so that the line finally breaks.

Figure 11:
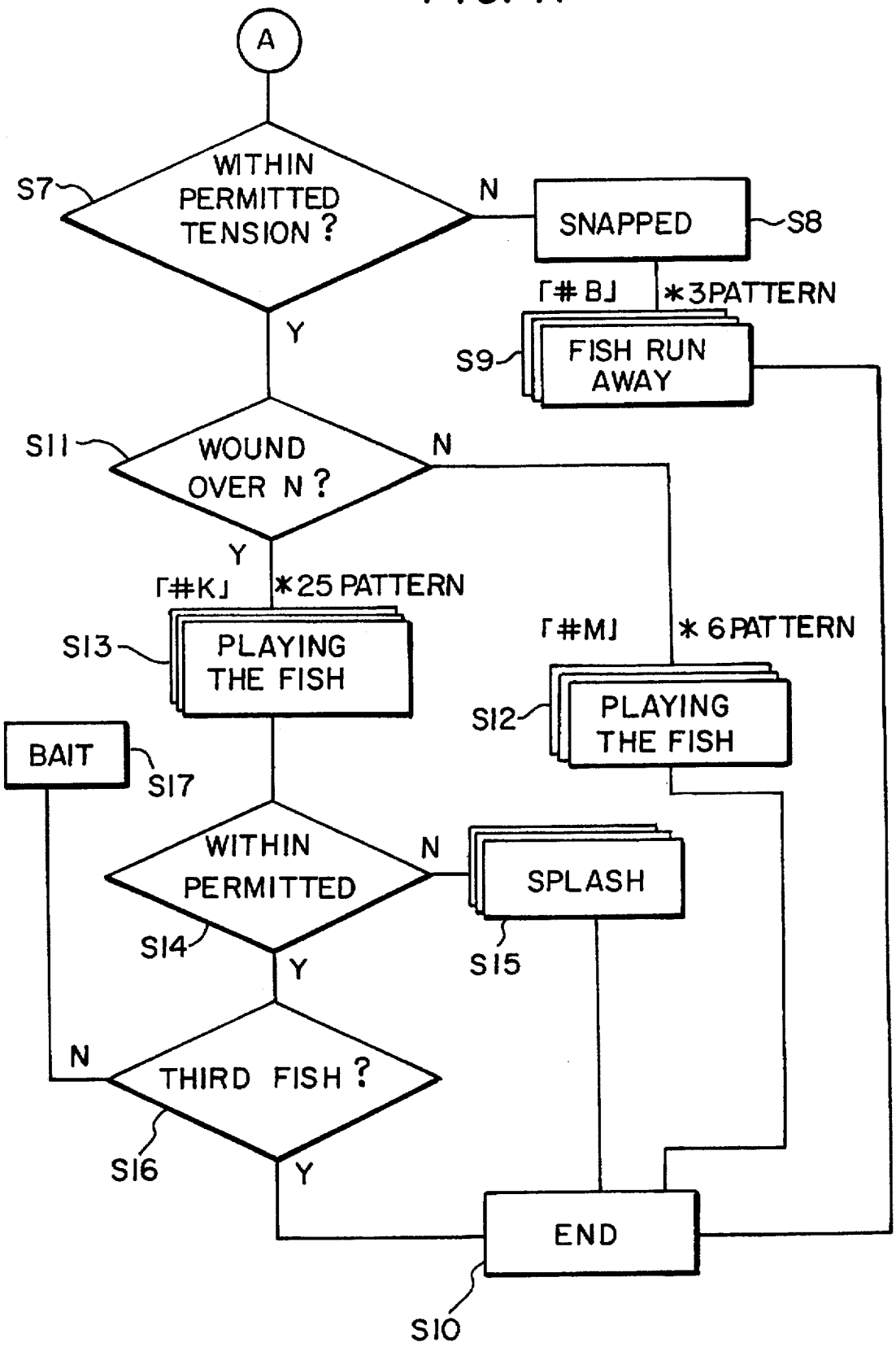
FIG. 11 is a flowchart (No. 2) showing the operation of the fishing game device of the present invention.
Figure 12:
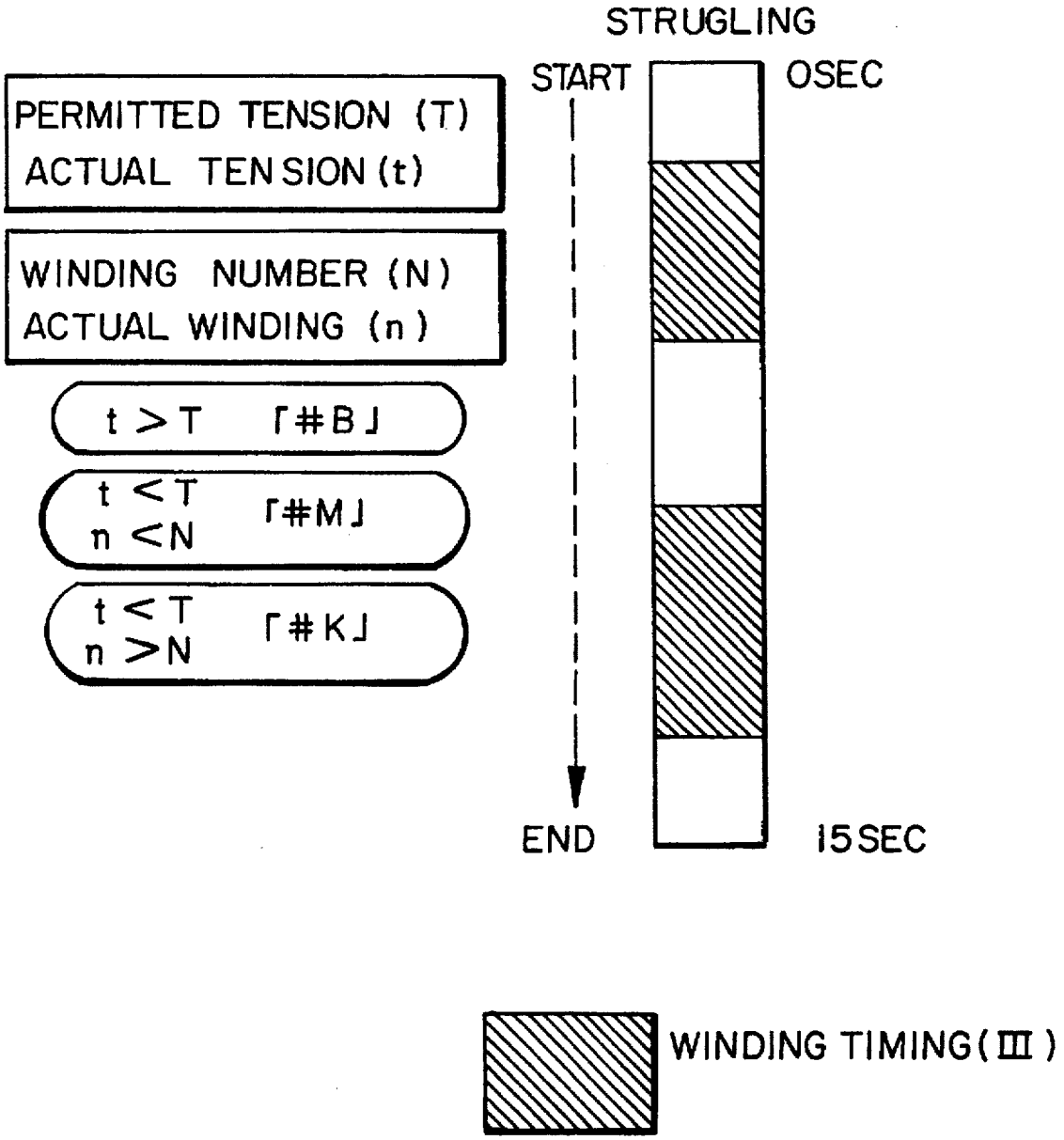
FIG. 12 is a time chart for the operation in FIG. 11.

In the fishing game device according to the present invention, as is shown the flowchart in FIG. 11 for the following process, a check is performed to determine whether or not a tension that is greater than a permitted tension T has been applied to the fishing line 40 (step S7). The determination at step S7 is performed as follows.

When fishing rod 30 is moved upward drastically by the player 10, the fishing line 40 that is fixed to the tip of the fishing rod 30 is accordingly pulled upward. Thus, the take-up drum 78, of the take-up device 2, around which the fishing line 40 is wound, is rotated at a speed that corresponds to the speed at which the fishing rod 30 is moved upward, and the fishing line 40 is fed out.

In accordance with the rotation of the take-up drum 78 of the take-up device 2, a pulse signal is output by the sensor 83. The main board 3 counts the number of pulses during a predetermined time. The count value is employed as an actual tension t and is compared with a predetermined permitted value T.

As the result of the comparison, when the actual tension t is greater than the predetermined permitted value T (t>T), it is assumed that a tension greater than the permitted value has been applied to the fishing line 40 (step S7:N) and a line breaking process is performed.

In the line breaking process, first, a sound effect, a "snap," that represents the breaking of the line is output by the sound board 5 under the control of the main board 3 and is released through the loudspeaker 53 (step S8).

Sequentially, a scene wherein a fish is shown getting away into the water is read from the laser disk player 4 and displayed on the monitor 43. In this embodiment, three scene patterns are prepared for scenes showing a fish getting away, and are displayed at random (step S9). Finally, the fishing result data are displayed and the game is thereafter terminated (step S10).

As is described above, for the determination of whether or not a tension greater than the permitted value T is applied to the fishing line 40, it is assumed, as part of the simulation, that in accordance with the rotation of the take-up drum 78 of the take-up device 2, the fishing rod 30 is sharply raised and travels upward a specific distance within a predetermined period, and as a result a tension greater than a predetermined value is applied to the fishing line 40. However, the present invention is not limited to the above described example, and a procedure may be employed wherein the number of rotations of the handle 11 of the simulated reel 1 over a predetermined time are compared with a predetermined value.

As another mode for determining whether the fishing line 40 is broken, both the travel distance of the fishing rod 30 and the number of rotations of the handle 11 of the simulated reel 1 over a specific time can be employed.

Another control for determining whether the line is broken will now be explained. The cause of a fishing line break during actual fishing is that the sum of tension that is applied to a fishing line due to the drag provided by a fish, the tension that is applied to the fishing line by the winding of a reel, and the tension that is applied to the fishing line by the elevation of a fishing rod exceeds a permitted value for the fishing line. As the another control method, the tension on a fishing line due to the drag provided by a fish is acquired by a program in the program memory 133 of the main board 3, the tension caused by the winding of a reel is acquired by a winding detection signal E1 from the encoder that is provided for the simulated reel 1, and the tension due to the elevation of the fishing rod 30 is acquired from the degree to which the fishing rod 30 is bent, which is calculated with an angle detection signal RA from the angle detector 7 and a signal E2 from the encoder in the take-up device 2. The position of the tip of the fishing rod 30 can be determined with the encoder signal E2 from the take-up device 2, and the angle at the proximal end of the fishing rod 30 can be determined with the angle detection signal RA, so that the tension that corresponds to the degree of bending of the fishing rod 30 can be calculated with these signals. As previously described, the signal E2 from the encoder of the take-up device 2 can be employed alone rather than in concert with the angle detection signal RA.

The main board 3 compares the sum of three tension values with a permitted tension value that is set in advance for each fish type, and determines whether the fishing line 40 is broken. Therefore, while the player 10 is made aware of the movement of a fish by a torque or a braking force that is applied to the fishing rod 30 and the simulated reel 1, the player 10 must so manipulate the fishing rod 30 and so rotate the handle 11 of the simulated reel 1 that the total tension does not exceed the permitted value.

The braking control is performed for the simulated reel 1 by the main board 3 in accordance with the strength of the drag provided by a fish that is given by the program; the bending of the fishing rod 30 that is calculated with the angle signal RA from the angle detector 7 that detects the angle of the fishing rod 30, and the signal E2 from the encoder of the take-up device 2; and the rotation speed that is detected by the encoder of the simulated reel 1. When the fishing rod 30 is pulled up and greatly bent, the tension to the fishing line 40 should be increased, and thus the braking force is also increased. When the fishing rod 30 is to return to the original position, the bending is reduced, and the braking is also reduced.

Similarly, the take-up drum 78 of the take-up device 2 is controlled by the main board 3 in accordance with the strength of the drag provided by a fish that is given by the program, the angular velocity level from the angle detector 7 that detects the angle of the fishing rod 30, and the rotation speed that is detected by the encoder of the simulated reel 1.

According to the present invention, unlike the prior art, the take-up device 2, for winding the fishing line 40 that is fixed to the tip of the fishing rod 30, is not connected through a single fishing line to the simulated reel 1 that is attached to the fishing rod 30. This structure can provide a highly durable game device that is appropriate for installation in a game center, etc. Thus, a torque almost equivalent to the torque that an angler experiences during actual fishing is applied to the fishing rod 30 and the simulated reel 1 that the player 10 manipulates. For this, as is described above, in accordance with the winding detection signal E1 from the encoder of the simulated reel 1, the angle detection signal RA that indicates the vertical movement of the fishing rod 30, and a winding signal which represents the wound-in length of the fishing line 40 and is supplied by the main board 3 to the clutch controller 32, the main board 3 transmits control signals CL1 and CL2 respectively to the clutch controller 32 and the clutch controller 31 for the simulated reel 1. As a result, the player 10 feels the torque at the handle 11 of the simulated reel 1 and the fishing rod 30. That torque value includes a value for the degree to which the fishing rod 30 is bent. Therefore, the fishing game device of this invention is very durable and enables a player to experience the same sensation as when actually fishing.

As the game progresses, a check is performed to determine whether the fishing line 40 has been wound in a distance that is equivalent to a given value N or greater (step S11). The decision at step S11 is made in accordance with the winding timing (III) in FIG. 12.

In the fishing game device of the present invention, the simulated reel 1 is not connected to the fishing line 40, which is fed from the take-up device 2, in order to facilitate maintenance. Therefore, the value n of the fishing line 40 that is wound in by the simulated reel 1 can not be determined by the rotation count of the take-up drum 78 of the take-up device 2.

According to the present invention, an encoder 15 is provided for the simulated reel 1. As was previously described, the encoder 15 transmits to the main board 3 an electric signal E1 that corresponds to the number of rotations of the handle 11 of the simulated reel 1.

Upon the receipt of the electric signal E1 from the encoder 15 that corresponds to the rotation count of the handle 11 of the simulated reel 1, the main board 3 determines whether the rotation count n equal to or greater than a predetermined number N has been input during a predetermined winding time period (III). The predetermined winding time period is some fixed time period that starts from the fish-on.

In the predetermined period, when provided is an input electric signal corresponding to the predetermined number N or greater, i.e., the input rotation count n of the handle 11 of the simulated reel 1 equal to or greater than the value N ($t<T$, $n \geqq N$), it is assumed that the length of the fishing line 40 that has been wound in is the predetermined amount N or greater (step S11:Y).

In the predetermined period, when provided is the input electric signal corresponding to a value that is smaller than the predetermined number N, i.e., the input rotation count n of the handle 11 of the simulated reel 1 smaller than the value N ($t<T$, $n<N$), it is assumed that the fishing line 40 has not been wound by the predetermined amount N or greater (step S11:N). A scene where a fish run away during a struggle is displayed (step S12). Six patterns for such a scene are prepared in this embodiment and are displayed at random in accordance with the fish type.

The scenes differ in accordance with the fish type because the fish type is decided in accordance with the game play level that is input by the player 10 before beginning the game.

When, at step S11, the length of the fishing line 40 that has been wound is equal to or greater than the predetermined value N (step S11:Y), a fight scene, in accordance with the fish type, wherein a fish gradually rises to the surface of the water is displayed (step S13). The same reason for selecting the display at step S12 applies in this case also, where a fight scene that corresponds to the fish type is displayed.

Sequentially, in the same manner as at step S7, a check is performed to determine whether or not the tension t on the fishing line 40 is within the range of the permitted tension T (step S14). When the tension t on the fishing line 40 is equal to or greater than the permitted tension T (step S14:N), a fish that has risen above the water surface drops back into the water again, and a splashing sound is released through the loudspeaker 53, and a scene showing a fish getting away is displayed (step S15). The fishing record is displayed and the game is thereafter terminated (step S10).

If, at step S14, the tension t of the fishing line 40 is within the range of the permitted tension T ($t<T$), a check is performed to determine whether or not the current landed fish is the third one, i.e., whether or not this is the third game (step S16). In this embodiment, when the player 10 succeeds in landing a fish, he can continue playing the fishing game up to three times. Therefore, if the fish is not the third, a baiting scene is displayed (step S17), and the game returns to the start. When the fish that is landed at this time is the third one (step S16:Y), the fishing record is displayed and the game is thereafter terminated.

In FIG. 3, the fishing game device of the present invention includes a lamp unit 63, by which instructions are given to the player 10 and by which effective decorative illumination is provided, and a semiconductor switch relay board 62, which controls the lamp unit 63.

[Take-up device using a hydraulic pump]

In the above embodiment, the take-up device that uses two magnetic particle clutches is employed.

In order to control the coupling effect by the two magnetic particle clutches, the above game device applies a load as a bite at the tip of the fishing rod in accordance with the dragging speed and strength that corresponds to a fish type, when a player performs the hooking of a fish by pulling up the fishing line at a given timing. Further, the game device applies a load at the tip of the rod regarding the condition of the drag provided by the fish and the breaking of the line through a predetermined timing and speed.

However, as inherent problems related to the magnetic particle clutches, first, it takes much time following the reception of an electric control signal for the magnetic particles to become excited and for a torque at the input shaft to be transmitted to the output shaft. It also takes much time following the halting of the supply of an excitation current for the magnetic particles to be de-electrified and for the transmission of a torque to the output shaft to cease. Thus, a quick response can not be provided, and only unrealistic operations can be provided for the fishing rod that is handled by a player. Especially in order to simulate the playing of a large fish, a fast and strong force must be applied to the tip of the fishing rod to reproduce those situations where the large fish is struggling near the water surface during the fight and where the fishing line is broken. Such control is difficult to supply when the magnetic particle clutches are used.

Second, because of transient changes in the magnetic particle clutches upon the magnetization of particles, the torque at the output shaft may be changed. Thus, the torque changes that is first set in accordance with a fish type and the operation.

Third, since the torques of the two magnetic particle clutches that rotate in opposite directions are transmitted by a belt, the belt can be stretched or damaged, and the maintenance costs will be high.

As another embodiment for the take-up device 2, therefore, a device that employs a hydraulic pump is proposed.

Since the fishing game device uses a hydraulic motor to rotate a take-up drum, such problems that arise with the magnetic particle clutches are eliminated. Further the transmission of a torque and the inversion operation are fast, and the inversion operation can be performed at a higher speed with a greater torque. In addition, the torque control for simulation which corresponds to, for example, a situation where a large fish is struggling near the water surface can be performed, which can not be reproduced by using the magnetic particle clutches. The change in an output torque in accordance with a transient change is extremely smaller than that for the magnetic particle clutch, and the output torque that is set first is prevented from being changed as time elapses.

Figure 13:
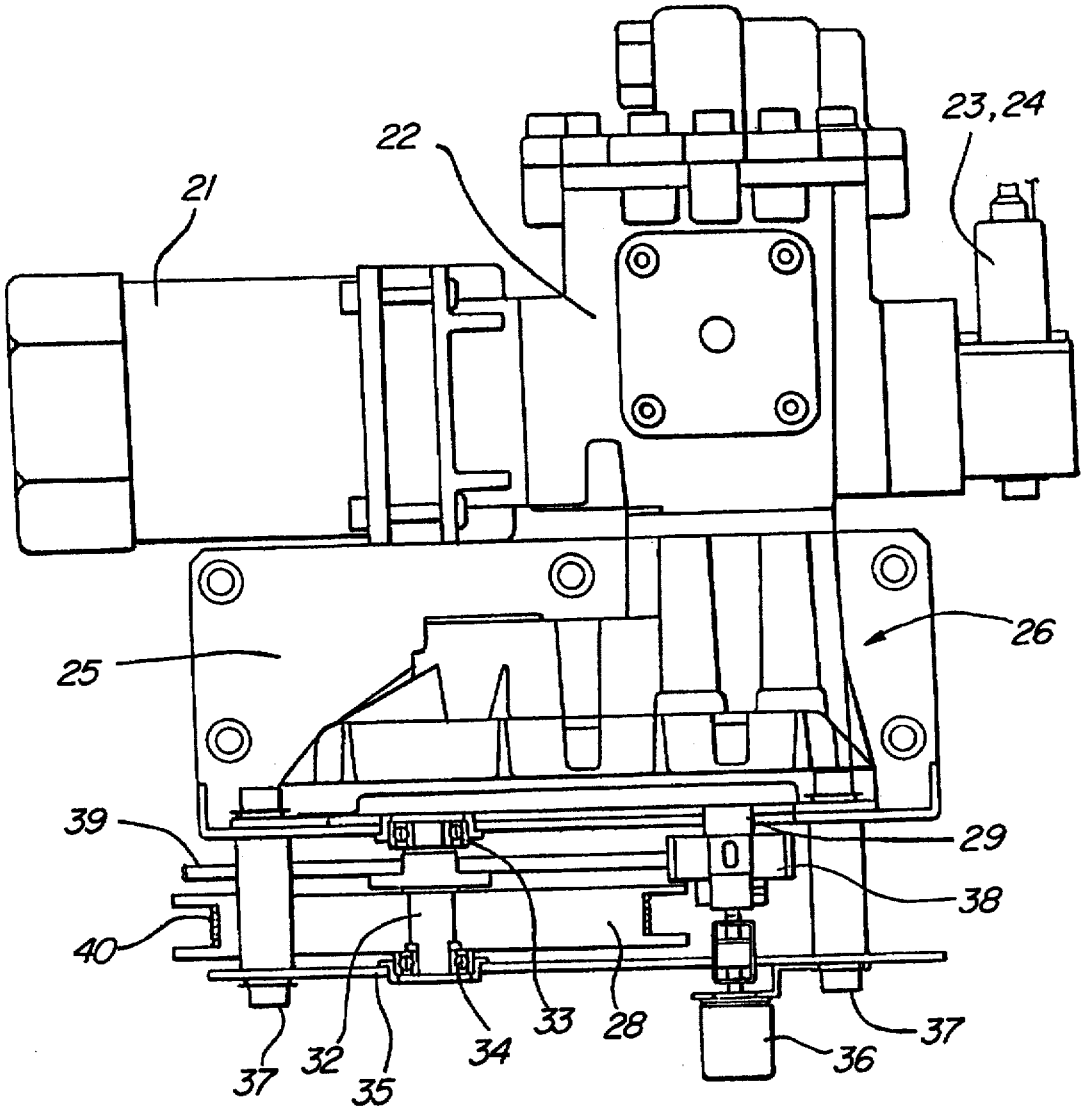
FIG. 13 is a top view of the fishing line take-up device.
Figure 14:
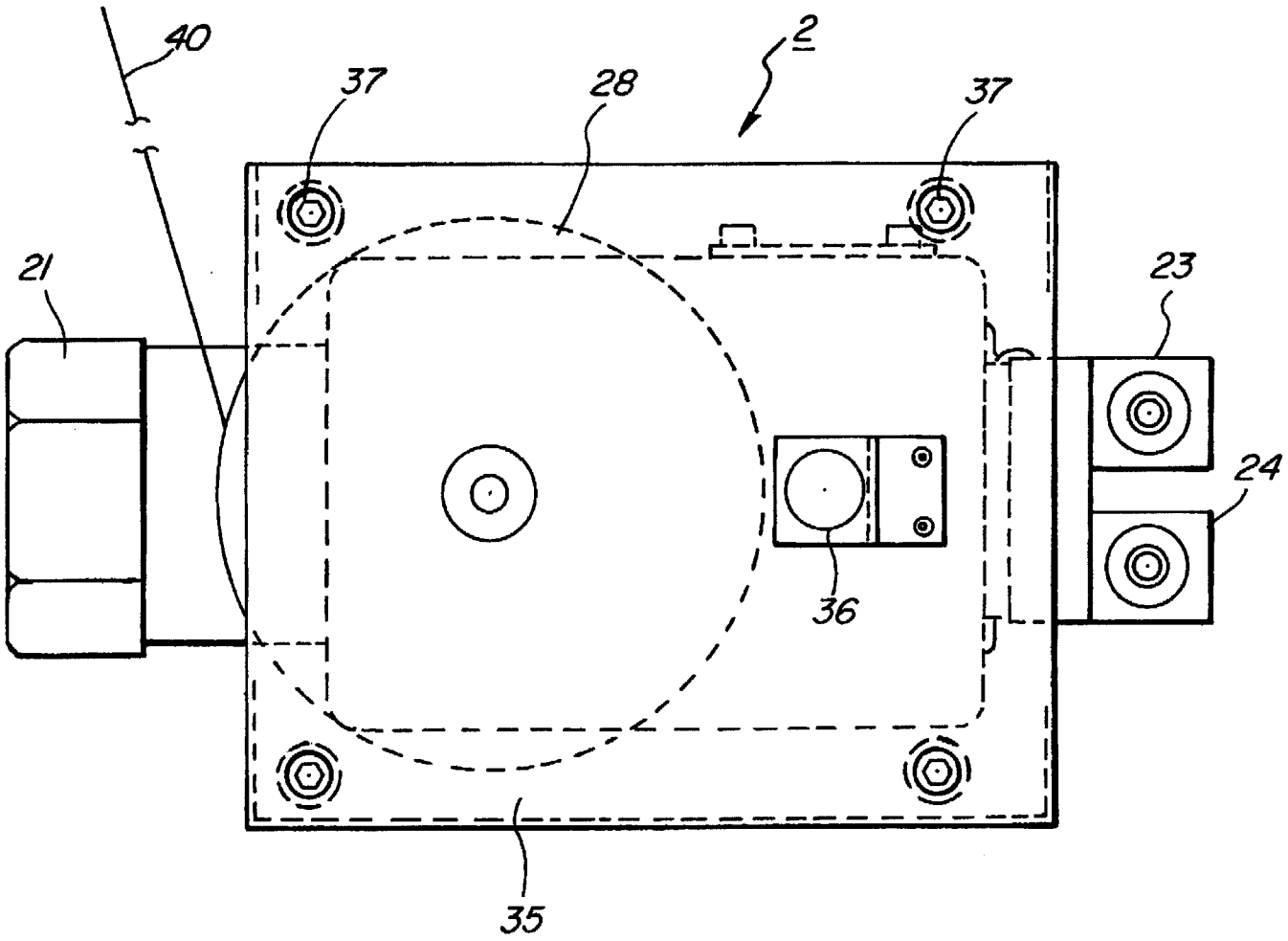
FIG. 14 is a side view of the fishing line take-up device.

FIG. 13 is a plan view showing the relationship between the hydraulic motor of the take-up device 2 in this embodiment and a take-up drum, and FIG. 14 is a side view.

The take-up device 2 includes a hydraulic pump 22 for supplying oil from an oil tank 25 to a hydraulic circuit under a steady pressure so that oil is circulated in the circuit; a hydraulic pump drive motor 21 for driving the hydraulic pump 22; and two solenoid valves 23 and 24 for controlling the direction in which oil is supplied to a hydraulic motor 26 and the amount of oil that is supplied (oil pressure).

An output shaft 29 of the hydraulic motor 26 drives a take-up shaft 32 of a take-up drum 28 via an output gear 38 and a driven gear 39. The take-up shaft 32 is attached through ball bearings 33 and 34 to the main body of the hydraulic pump 25 and a shaft receiving plate 35, which is secured by four screws 37. An encoder 36 is fitted around the distal end of the output shaft 29 of the hydraulic motor 26 to read the rotation count of the output shaft 29.

Further, a fishing line 40 that extends from the tip of a fishing rod 30 is wound around the take-up drum 28.

Figure 15:
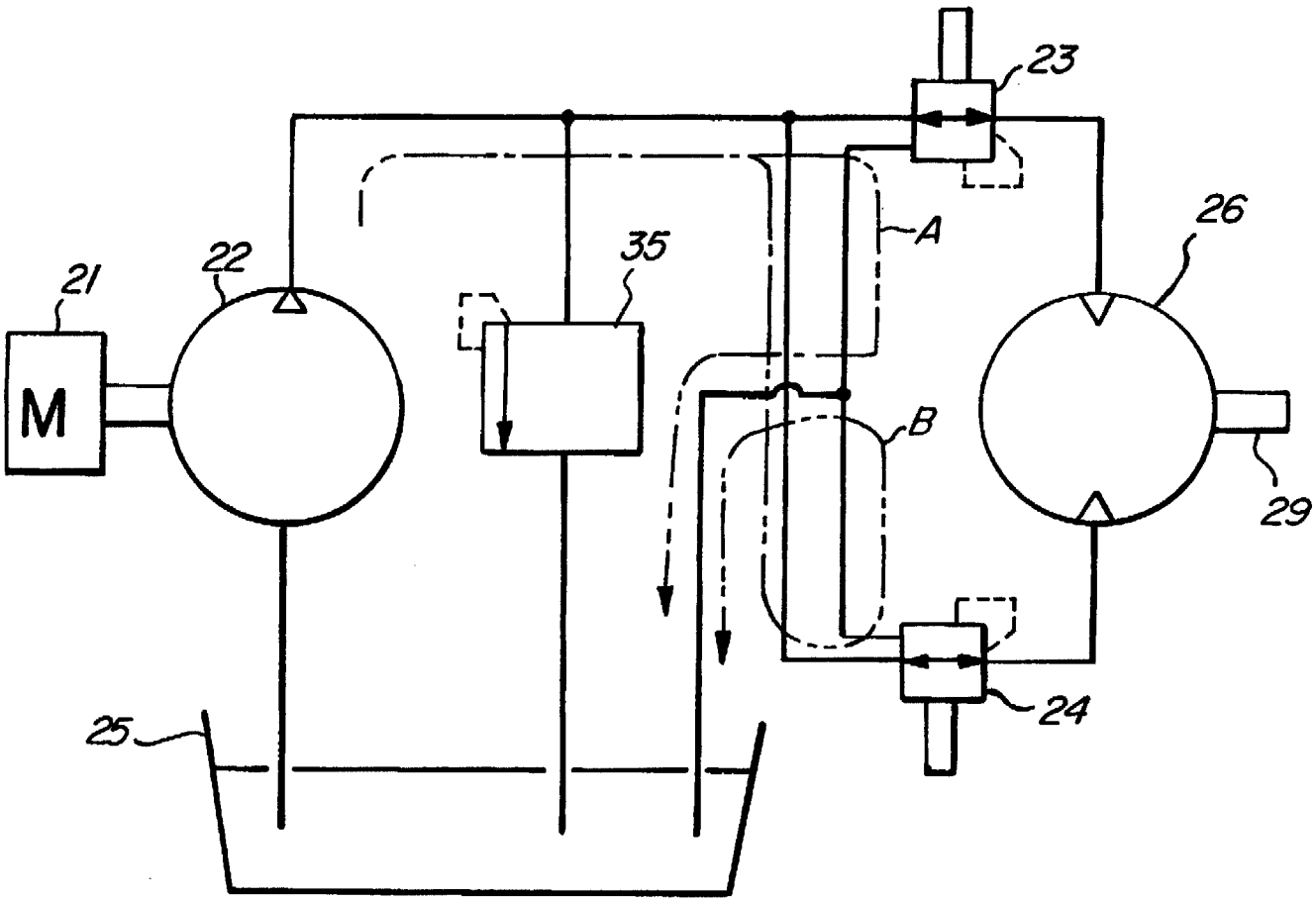
FIG. 15 is a diagram illustrating a hydraulic circuit of a hydraulic motor.

In FIG. 15 is shown a hydraulic circuit for the hydraulic motor 26 in FIGS. 13 and 14. The same reference numbers as are used in FIGS. 13 and 14 are also used to denote corresponding or identical components.

The operation of the hydraulic circuit in FIG. 15 is as follows. A constant quantity of oil (under a constant pressure) from the oil tank 25 is circulated, as is indicated by chain lines A and B, by the hydraulic pump 22, which is driven by the rotation of the hydraulic pump driving motor 21.

When a control current is supplied to a coil of the solenoid valve 23, which is a proportioning valve, the valve 23 is opened to the degree that corresponds proportionally to the value of the supplied current. Then, the oil that is circulating and that is indicated by the chain line A is supplied to the hydraulic motor 26 in the amount (the pressure) that corresponds to the degree to which the valve 23 is opened, and the output shaft 29 is rotated in one direction with a torque that corresponds proportionally to the oil pressure.

Likewise, when a control current is supplied to the coil of the solenoid valve 24, which is a proportional valve, the valve 24 is opened to the degree that corresponds proportionally to the current value. Oil that is circulating and that is indicated by the chain line B is supplied to the hydraulic motor 26, and the output shaft 29 is rotated in the other direction with a torque that corresponds proportionally to the oil pressure.

If the ratio of the control current for the solenoid valve 23 to the control current for the solenoid valve 24 is, for example, 70% to 30%, the hydraulic motor 26 rotates in one direction with a torque that corresponds proportionally to 40%, which is the difference between the two control current values. Therefore, the switching of the rotational direction and the adjustment of a rotational torque at any level can be performed.

When a relief valve 35 is opened, the circulating oil is forcibly returned to the oil tank 25.

Compared with a magnetic particle clutch, the above described hydraulic motor requires only a short period (a short time lag) following the supply of a control current to the solenoid valves 23 and 24 for an output torque to be transmitted to the output shaft 29, and has a fast response. According to a test that was performed with a model that the present inventor constructed, its response time could be shortened by about 60%, compared with the response of the magnetic particle clutch. In addition, a response time for rotation start with a large torque, and a response time for inverse rotation are also short, so that the movements of various types of fish can be reproduced. As for its durability, there are no transient changes, such as are experienced with a magnetic particle clutch, a belt is not required for the transmission of a torque, and the device structure does not easily malfunction.

As is described above, since the rotational direction of the hydraulic motor and the torque (the rotational force) can be freely changed by controlling the current for the solenoid valves 23 and 24 in the hydraulic circuit of the hydraulic motor, the movements that correspond to the program of a game can be transmitted to a tip 31 of the fishing rod 30 through a fishing line, which is to be wound around the take-up drum 28.

The employment of the hydraulic motor effectively reproduces the sensation that is provided for the above described "bite." In this embodiment, since the take-up drum 28 is rotated by using the hydraulic motor, as is previously described, a control signal is transmitted to the solenoid valves 23 and 24, as needed, to rotate the drum 28 to express delicate and fast vibration for each fish type. Especially, the fast, small vibrations that accompany the movement of small river fishes, such as the scorpionfish, can be adequately reproduced. In addition, since, unlike a magnetic particle clutch, there is no transient change due to the magnetization of iron powder, the take-up drum 28 can be properly rotated forward and backward for an extended time period with the control current that is initially set.

In the situation when a fish is being played, the strength of the drag provided by a fish that is determined in accordance with the fish type is applied at the tip 31 of the fishing rod 30. At the take-up device 2, a control current, which corresponds to the fish type, is supplied to the solenoid valves 23 and 24 to control the rotation of the hydraulic motor 26 with an adequate torque and a proper rotation switching time. Unlike the magnetic particle clutch, since the torque is transmitted fast and the rotation switching is also performed fast, the strength of the torque can be controlled at any level. Therefore, the drag that is provided by a small fish, such as a scorpionfish, up to that which is provided by a large fish, such as a swordfish, can be more realistically reproduced at a fishing rod.

In these embodiments, in the line breaking process, the strong and fast reactions of an especially large fish, such as a sword fish, can more realistically be simulated at the take-up drum 28. In other words, for the simulation for a large fish, the rotational direction of the hydraulic motor 26 must be inverted when the oil pressure to the hydraulic motor 26 is increased. In such a case, with the employment of the conventional magnetic particle clutches, the powder (iron particles) that are strongly excited must be de-electrified, and a time lag occurs, especially in this process. On the other hand, to change the oil pressure that is supplied to the hydraulic motor 26, merely a coil current needs to be changed for vertically moving the solenoid valves 23 and 24, which are proportioning valves. Further, the transmission of oil is performed momentarily, and a strong and fast reaction can be realized very easily.

In addition, when a fish appears on the water surface during actual fishing, the fish struggles very violently, and vibration at a high frequency is applied to a fishing rod. By using the hydraulic motor in this embodiment, high frequency switching of the forward and the backward rotations can be performed, especially with the large torque that is provided by a large fish. As a result, the fishing game device can more realistically simulate the movements of a fish.

As is described above for the embodiments, the present invention can provide a player with an experience that is as close as possible to real fishing. Further, a highly durable fishing game device that has a simple structure, and for which excellent maintenance can be provided, is produced by taking into consideration its use by many and unspecified players.

What we claim are:

1. A fishing game device comprising:

line take-up means rotatable forward and reverse;

a fishing rod, to a distal end of which is fixed a fishing line fed from the line take-up means;

a simulated reel attached to a side opposite to the distal end of the fishing rod and including a handle to be rotated by a player and a brake mechanism for applying a load braking force to the movement of the handle; and control means for controlling a magnitude of the load braking force of the braking mechanism in accordance with the rotational state of the line take-up means.

2. A fishing game device of the claim 1, wherein: the line take-up means includes a motor rotating unidirectionally;

two clutches, each of which have an input shaft and an output shaft, for being electromagnetically controlled the coupling magnitude of the input shaft and the output shaft;

first transmission means for transmitting the rotation of the motor to the two clutches so that the input shafts thereof are rotated in opposite directions;

a drum around which the fishing line is taken up; and second transmission means for transmitting the rotation of the output shafts of the two clutches to the drum.

3. A fishing device of the claim 2, further comprising a take-up encoder for outputting an electric signal which corresponds to the rotational amount of the drum.

4. A fishing device of the claim 1, wherein:

the simulated reel further includes a rotary portion coupled with the handle and a reel encoder for outputting an electric signal which corresponds to the rotational amount of the rotary portion, the braking mechanism includes a rotation mechanism portion coupled with the rotary portion and a fixing mechanism portion, and the coupling amount of the rotation mechanism portion and the fixing mechanism portion is electromagnetically controlled.

5. A fishing game device of the claim 3, the simulated reel further including a rotary portion coupled with the handle and an reel encoder for outputting an electric signal which corresponds to the rotational amount of the rotary portion, the braking mechanism including a rotation mechanism portion coupled with the rotary portion and a fixing mechanism portion, and the coupling amount of the rotation mechanism portion and the fixing mechanism portion being electromagnetically controlled; and said control means controlling the coupling amount of the rotation mechanism portion and the fixing mechanism portion in the simulated reel according to the output of the take-up encoder, and the coupling amount of the input shaft and the output shaft if the two clutches in the line take-up means according to the output of the reel encoder.

6. A fishing game device of one of the claims of 1 through 5: further comprising a monitor for displaying a video of the fishing, the control means controlling a switching of the video of the fishing based on the output of the take-up encoder and the reel encoder.

7. A simulated reel comprising:

a handle being rotatable;

a rotary portion having a shaft with the same direction as a shaft of the handle and being rotated according to the rotation of the handle;

an encoder for outputing an electric signal corresponding to a rotation amount of the rotary portion;

a rotation mechanism coupled to the rotary portion; and a fixing mechanism portion, the coupling amount to the rotation mechanism being controlled electromagnetically, wherein a load breaking force is applied to the rotation of the handle by controlling the coupling amount of the rotation mechanism and the fixing mechanism.

8. A fishing game device comprising:

line take-up means having a line take-up drum being rotatable forward and reverse which takes up and feeds out a line;

a fishing rod, to a distal end of which the line fed out from the line take-up drum is fixed, being operable by a player so that the distal end moves up and down; and control means for controlling a rotation of the line take-up drum according to a predetermined simulation program, and said line take-up means further comprising;

a hydraulic pump for circulating an oil into an oil circuit under a predetermined pressure;

a hydraulic motor provided in the oil circuit for transferring the output torque thereof to the line take-up drum;

a first solenoid valve being supplied a first control current depending on a control signal from the control means and supplying an oil having an pressure depending on the first control current to the hydraulic motor so as to rotate the motor in one direction; and a second solenoid valve being supplied a second control current depending on a control signal from the control means and supplying an oil having an pressure depending on the second control current to the hydraulic motor so as to rotate the motor in another direction.

9. A fishing game device of the claim 8: wherein said line take-up means includes a take-up encoder for supplying an electric signal depending on the rotation amount of the line take-up drum.

10. A fishing game device of the claim 8 further comprising:

a simulated reel, attached to the other side of the distal end, being rotated by the player, the simulated reel having a reel encoder supplying an electric signal depending on the rotation amount thereof to the control means and a breaking means for breaking the rotation of the simulated reel in response to a control signal from the control means.

11. A fishing game device of one of the claims 8 through 10 further comprising a monitor, controlled by the control means, for displaying a predetermined fishing video according to the predetermined simulation program.

12. A fishing game device comprises:

line take-up means including a line take-up drum winding in and feeding out a fishing line and a hydraulic motor rotatable forward and backward and transmitting a rotational torque to the line take-up drum;

a fishing rod connected at the tip thereof to the fishing line fed from the line take-up drum; and control means for rotating the hydraulic motor forward and backward in accordance with a predetermined simulation program.

13. A fishing game device comprising:

a fishing rod, to a distal end of which a line is fixed, being moved up and down by a player, and being flexible;

line take-up means, connected to the other end of the line, for controlling the taking-up and feeding out of the line;

a simulated reel attached to the fishing rod at the other side of the distal end and including a handle being rotated by the player and a braking mechanism for providing a braking load to the rotation of the handle; and control means for controlling the amount of the braking load from the braking mechanism depending on a tension applied to the line by the line take-up means.

14. A fishing game device of the claim 13, wherein the strength of the tension applied to the line is determined depending on a take-up speed of the simulated reel.

15. A fishing game device of the claim 13, wherein the strength of the tension applied to the line is determined depending on the amount of bending of the fishing rod.

16. A fishing game device of the claim 15, wherein the amount of the bending of the fishing rod is determined by an angle of the fishing rod and a taking-up amount of the line by the line take-up means.

17. A fishing game device comprising:

a fishing rod, to a distal end of which a line is fixed, being moved up and down by a player, and being flexible;

line take-up means, connected to the other end of the line, being controllable to rotate forward and reverse for the taking-up and feeding out of the line;

a first rotation detection means for detecting a rotation state of the line take-up means;

a simulated reel attached to the fishing rod at the other side of the distal end and including a handle being rotated by the player and a braking mechanism for providing a braking load to the rotation of the handle;

a second rotation detection means for detecting a rotation state of the handle; and control means, including a storage medium for storing a computer readable program to reproduce a fishing, for controlling a rotation torque of the line take-up means according to the program and controlling the amount of the braking load from the braking mechanism depending on detection signals from the first rotation detection means and a second rotation detection means.

18. A fishing game device of the claim 17 further comprising:

am angle detection means for detection an angle of the fishing rod, wherein the control means calculates a bending amount of the fishing rod depending on the angle detection signal from the angle detection means and the detection signal from the first rotation detection means, and controls the braking mechanism so as to provide the breaking load depending on the amount of bending of the rod.

19. A fishing game device of the claim 17 wherein;

the computer readable program for the fishing includes a program code means for providing the line take-up means with a torque according to a bite of fishing, and providing the line take-up means with a torque according to a fish-on of the fishing depending on the signal detecting the change of angle of the rod provided by the angle detection means at a predetermined timing.

20. A fishing game device of the claim 17 wherein;

the computer readable program for the fishing includes a program code means for having the control means provide the line take-up means with a torque corresponding to a snap action of the line when a tension to the line which is determined by a tension depending on the drag amount of a fish provided by the computer program and a tension depending on the detection signal from the second rotation detection means is larger than a predetermined value.

21. A fishing game device of the claim 18 wherein;

the computer readable program for the fishing includes a program code means for having the control means provide the line take-up means with a torque corresponding to a snap action of the line when a tension to the line which is determined by a tension depending on the drag amount of a fish provided by the computer program, a tension depending on the detection signal from the second rotation detection means and a tension depending on the amount of the rod bending is larger than a predetermined value.

22. A fishing game device of claim 18 wherein:

the computer readable program for the fishing includes a program code means for providing the line take-up means with a torque according to a bite of fishing, and providing the line take-up means with a torque according to a fish-on of the fishing depending on the signal detecting the change of angle of the rod provided by the angle detection means at a predetermined timing.

* * * * *